US010040295B2

(12) United States Patent
Kudo et al.

(10) Patent No.: US 10,040,295 B2
(45) Date of Patent: Aug. 7, 2018

(54) LIQUID SUPPLY DEVICE, AND LIQUID EJECTION SYSTEM

(71) Applicant: SEIKO EPSON CORPORATION, Tokyo (JP)

(72) Inventors: Shoma Kudo, Shiojiri (JP); Munehide Kanaya, Azumino (JP); Naomi Kimura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/440,692

(22) Filed: Feb. 23, 2017

(65) Prior Publication Data

US 2017/0246878 A1 Aug. 31, 2017

(30) Foreign Application Priority Data

Feb. 29, 2016 (JP) ..... 2016-036519
Sep. 27, 2016 (JP) ..... 2016-187712

(51) Int. Cl.
*B41J 2/19* (2006.01)
*B41J 29/13* (2006.01)
*B41J 2/175* (2006.01)

(52) U.S. Cl.
CPC ..... *B41J 2/19* (2013.01); *B41J 2/175* (2013.01); *B41J 2/1752* (2013.01); *B41J 2/17509* (2013.01); *B41J 29/13* (2013.01)

(58) Field of Classification Search
CPC ..... B41J 2/17553
See application file for complete search history.

(56) References Cited

U.S. PATENT DOCUMENTS 4,791,438 A * 12/1988 Hanson ..... B41J 2/175 347/85
2007/0103520 A1* 5/2007 Wu ..... B41J 2/17513 347/86
2012/0050416 A1 3/2012 Ishizawa et al.

FOREIGN PATENT DOCUMENTS

JP 57002786 A * 1/1982 ..... B41J 2/19
JP 2012-051131 A 3/2012

* cited by examiner

*Primary Examiner* — Shelby Fidler
(74) *Attorney, Agent, or Firm* — Foley & Lardner LLP

(57) ABSTRACT

A liquid supply device that supplies a liquid to a head that ejects the liquid to an object includes a liquid storage chamber, an air introduction port, an atmospheric release flow path where one end is in communication with the air introduction port and another end is open to the atmosphere, and an air storage chamber configured to store air and provided in a portion of the atmospheric release flow path. A liquid supply flow path that supplies the liquid from the liquid storage chamber to the head is formed in a wall defining the air storage chamber. Thus, the size of a liquid ejection system is reduced.

16 Claims, 14 Drawing Sheets

LIQUID SUPPLY DEVICE, AND LIQUID EJECTION SYSTEM

BACKGROUND

Priority is claimed under 35 U.S.C. § 119 to Japanese Applications No. 2016-036519 filed on Feb. 29, 2016 and No. 2016-187712 filed on Sep. 27, 2016 which are hereby incorporated by reference in their entirety.

1. Technical Field

The present invention relates to a liquid supply device.

2. Related Art

A liquid ejection system provided with a printer as a liquid ejection device, a liquid supply device that supplies a liquid (for example, ink) to the printer, and an ink tube that connects the printer to the liquid supply device, is known. In JP-A-2012-51131, a configuration is described in which, in such a liquid ejection system, in order to suppress blockage of an ink flow path due to bending of a flexible ink tube, the ink tube is guided along a guide mechanism having a constant curvature.

In the liquid ejection system described in JP-A-2012-51131, because it is necessary to provide a guide mechanism within the liquid ejection device and the liquid supply device, there is a problem of increasing the size of the liquid ejection system. On the other hand, from the viewpoints of constraining installation space, insuring an attractive appearance, and the like, it is desired to reduce the size of the liquid ejection system.

SUMMARY

The present invention can be realized in the following embodiments.

1. According to one embodiment of the present invention, a liquid supply device is provided that supplies a liquid to a head that ejects the liquid to an object. This liquid supply device includes: a liquid storage chamber configured to store the liquid; a liquid injection portion in communication with the liquid storage chamber, and configured to inject the liquid into the liquid storage chamber; an air introduction port that is an opening provided in the liquid storage chamber to introduce air into the liquid storage chamber; an atmospheric release flow path where one end is in communication with the air introduction port, and another end is open to the atmosphere; and an air storage chamber configured to store air, and provided in a portion of the atmospheric release flow path. In this liquid supply device, a liquid supply flow path that supplies the liquid from the liquid storage chamber to the head is formed in a wall defining the air storage chamber.

According to the liquid supply device of this embodiment, the liquid supply flow path, which is a flow path that supplies the liquid from the liquid storage chamber to the head, is formed in a wall defining the air storage chamber. Therefore, in the liquid supply device of this embodiment, in comparison to a configuration in which the ink tube forming the liquid supply flow path and the air storage chamber are each separately provided, the space necessary in order to provide the liquid supply flow path can be reduced, and so the size of the liquid supply device can be reduced.

2. In the liquid supply device of the above embodiment, the liquid supply flow path, in the wall of the air storage chamber, may be formed protruding inside of the air storage chamber configured to store air, and not protruding outside of the air storage chamber.

According to the liquid supply device of this embodiment, the liquid supply flow path is not protruding outside of the air storage chamber. Therefore, the external shape of the air storage chamber including the liquid supply flow path can be simplified. As a result, for example in a configuration in which the liquid supply device is built into a liquid ejection device, it is possible to reduce the possibility that the liquid supply device will interfere with another member inside the housing of the liquid ejection device.

3. In the liquid supply device of the above embodiment, the liquid supply flow path, in the wall of the air storage chamber, may be formed protruding outside of the air storage chamber, which is the opposite side as the inside of the air storage chamber configured to store air, and not protruding inside of the air storage chamber.

According to the liquid supply device of this embodiment, the liquid supply flow path is not protruding inside of the air storage chamber. Therefore, it is possible to suppress a decrease in the volume within the air storage chamber due to including the liquid supply flow path.

4. In the liquid supply device of the above embodiment, the liquid storage chamber may further include, at a position facing an opening at one end of the liquid supply flow path, a liquid outlet portion that is an exit of the liquid from the liquid storage chamber.

According to the liquid supply device of this embodiment, the opening at one end of the liquid supply flow path provided in the air storage chamber, and the liquid outlet portion provided in the liquid storage chamber, are at positions facing each other, and therefore can be connected to each other in approximately a straight line. As a result, it is possible to easily connect the air storage chamber and the liquid storage chamber, and also, in comparison to a case where a connecting member (for example, an ink tube) is routed, the space necessary in order to dispose the connecting member can be reduced, and so the size of the liquid supply device can be reduced.

5. In the liquid supply device of the above embodiment, the air storage chamber may further include, at a position facing the air introduction port, an opening that functions as a portion of the atmospheric release flow path.

According to the liquid supply device of this embodiment, the air introduction port provided in the liquid storage chamber, and the opening provided in the air storage chamber, are at positions facing each other, and therefore can be connected to each other in approximately a straight line. As a result, it is possible to easily connect the air storage chamber and the liquid storage chamber, and also, in comparison to a case where a connecting member (for example, an air tube) is routed, the space necessary in order to dispose the connecting member can be reduced, and so the size of the liquid supply device can be reduced.

6. In the liquid supply device of the above embodiment, an opening at another end of the liquid supply flow path may be provided at an upper end in the vertical direction of the air storage chamber.

According to the liquid supply device of this embodiment, the opening at the other end of the liquid supply flow path is provided at the upper end in the vertical direction of the air storage chamber, so in a configuration in which a head is disposed above the air storage chamber in the vertical direction, liquid that has been let out from the liquid supply flow path can be smoothly sent toward the head.

7. In the liquid supply device of the above embodiment, a configuration may also be adopted in which the air storage chamber includes: a housing that is hollow and opens in one direction, an internal space of the housing forming the inside of the air storage chamber; and a first sealing member that seals the opening of the housing; and the liquid supply flow path includes: a groove that, in at least one wall of the housing, is formed so as to protrude toward the inside of the air storage chamber; and a second sealing member that seals the groove.

According to the liquid supply device of this embodiment, it is possible to simplify the external shape of the air storage chamber including the liquid supply flow path, and also possible to easily manufacture the air storage chamber and the liquid supply flow path using the sealing members.

8. The liquid supply device of the above embodiment may also include: a plurality of the liquid storage chambers; and a hollow air storage body, inside of which is configured the air storage chamber configured to be connected to each of the plurality of liquid storage chambers, the air storage body having an outer wall defining the air storage chamber. A plurality of the liquid supply flow paths in communication with the respective liquid storage chambers may be formed in the outer wall.

According to the liquid supply device of this embodiment, by using the air storage body where the plurality of liquid supply flow paths are provided, it is possible to reduce the size of the liquid supply device.

9. In the liquid supply device of the above embodiment, the air storage body may also include: a plurality of the outer walls intersecting each other; a plurality of grooves provided in a common outer wall that is one of the plurality of outer walls, the grooves constituting the plurality of liquid supply flow paths; and a groove sealing member joined to the common outer wall to seal the plurality of grooves.

According to the liquid supply device of this embodiment, it is possible to easily form the plurality of liquid supply flow paths in the air storage body.

10. In the liquid supply device of the above embodiment, a configuration may be adopted in which the air storage body internally has a plurality of the air storage chambers partitioned from each other, and each of the plurality of air storage chambers is connected to one corresponding liquid storage chamber among the plurality of liquid storage chambers.

According to the liquid supply device of this embodiment, liquid that has flowed out from each liquid storage chamber is suppressed from mixing together in the air storage body.

11. In the liquid supply device of the above embodiment, the air storage body may also include: a container portion that is hollow and opens in one direction, an internal space of the container portion being open in the one direction and partitioned by a plurality of recessed portions that constitute the plurality of air storage chambers; and a recessed portion sealing member that seals each of the recessed portions.

According to the liquid supply device of this embodiment, it is possible to easily configure the air storage body including the plurality of air storage chambers.

12. According to one embodiment of the present invention, a liquid supply device is provided that supplies a liquid to a head that ejects the liquid to an object. This liquid supply device includes: a liquid storage chamber configured to store the liquid; a liquid injection portion in communication with the liquid storage chamber, and configured to inject the liquid into the liquid storage chamber; an air introduction port that is an opening provided in the liquid storage chamber to introduce air into the liquid storage chamber; an atmospheric release flow path where one end is in communication with the air introduction port, and another end is open to the atmosphere; and an air storage chamber configured to store air, and provided in a portion of the atmospheric release flow path. In this liquid supply device, a liquid supply flow path that supplies the liquid from the liquid storage chamber to the head is disposed on a wall defining the air storage chamber.

According to the liquid supply device of this embodiment, the liquid supply flow path, which is a flow path that supplies the liquid from the liquid storage chamber to the head, is disposed on a wall defining the air storage chamber. Therefore, an increase in the space necessary in order to provide the liquid supply flow path can be suppressed, and so the size of the liquid supply device can be reduced.

13. According to one embodiment of the present invention, a liquid ejection system is provided that includes: the liquid supply device of the above embodiment; a liquid ejection device having the head; and a flow pipe that connects the liquid supply device to the head, and allows the liquid within the liquid storage chamber to flow to the head.

Not all of the plurality of constituent elements of each embodiment of the present invention described above are essential, and in order to solve some or all of the above-described problems, or alternatively, in order to achieve some or all of the above effects, some of the above plurality of constituent elements can be changed, deleted, or replaced with a new constituent element, or some limited content can be deleted, as appropriate. Also, in order to solve some or all of the above-described problems, or alternatively, in order to achieve some or all of the effects described in the present specification, some or all of the technical features included in one embodiment of the present invention described above can be combined with some or all of the technical features included in another embodiment of the present invention described above, to form an independent embodiment of the present invention.

Note that the present invention can be realized in various modes, for example, such as a mode of a liquid supply device, a liquid ejection device configured to be connected to a liquid supply device, a liquid ejection system including a liquid supply device and a liquid ejection device, a method of manufacturing these devices, a device manufacturing these devices, or an object where liquid is ejected by these devices. Also, the liquid supply device of the present invention can be implemented in a mode in which liquid is supplied to a recording head through a sub-tank or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

A-1. Configuration of Liquid Ejection System

Figure 1:
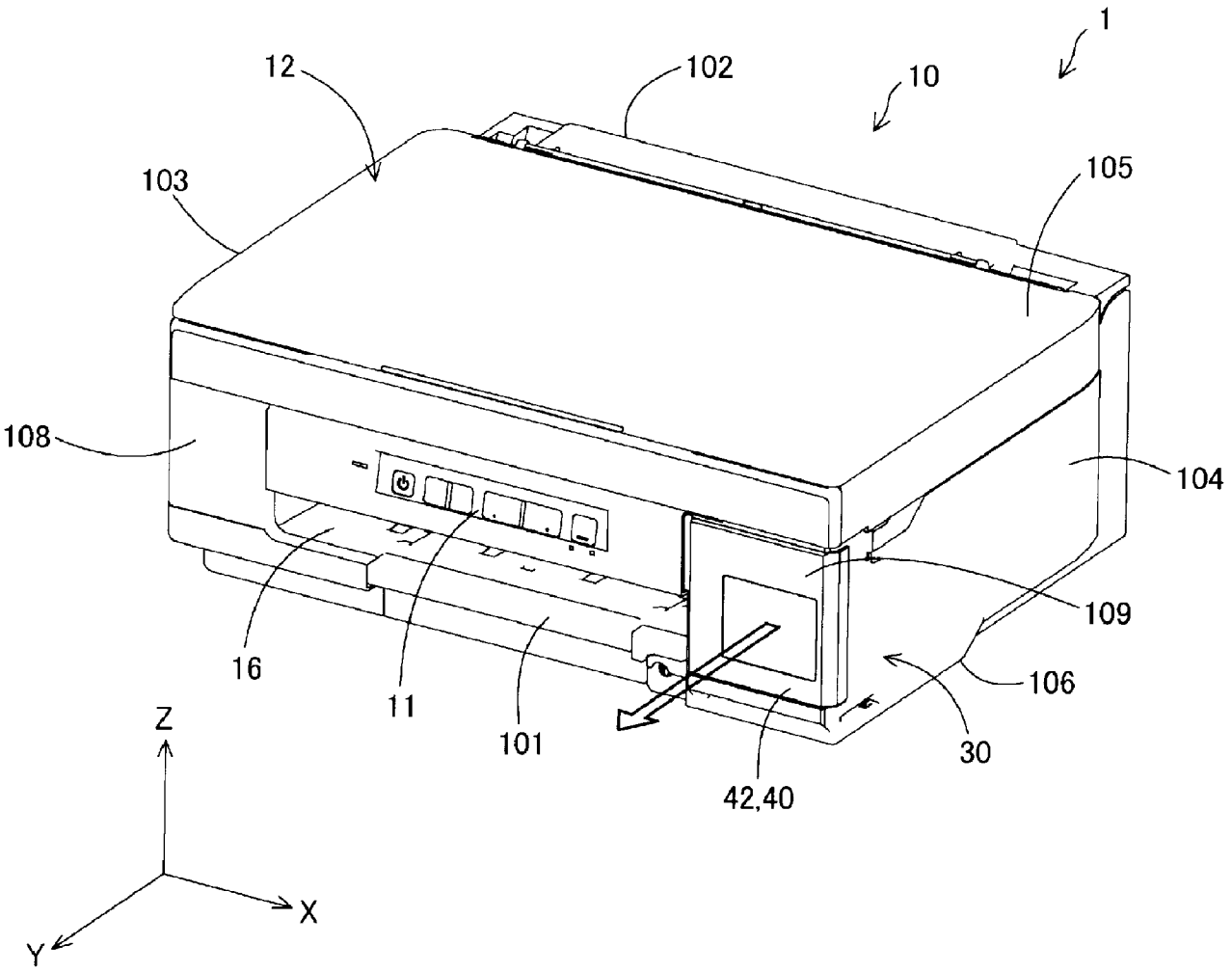
FIG. 1 is a schematic view of a liquid ejection system serving as a first embodiment of the present invention.
Figure 2:
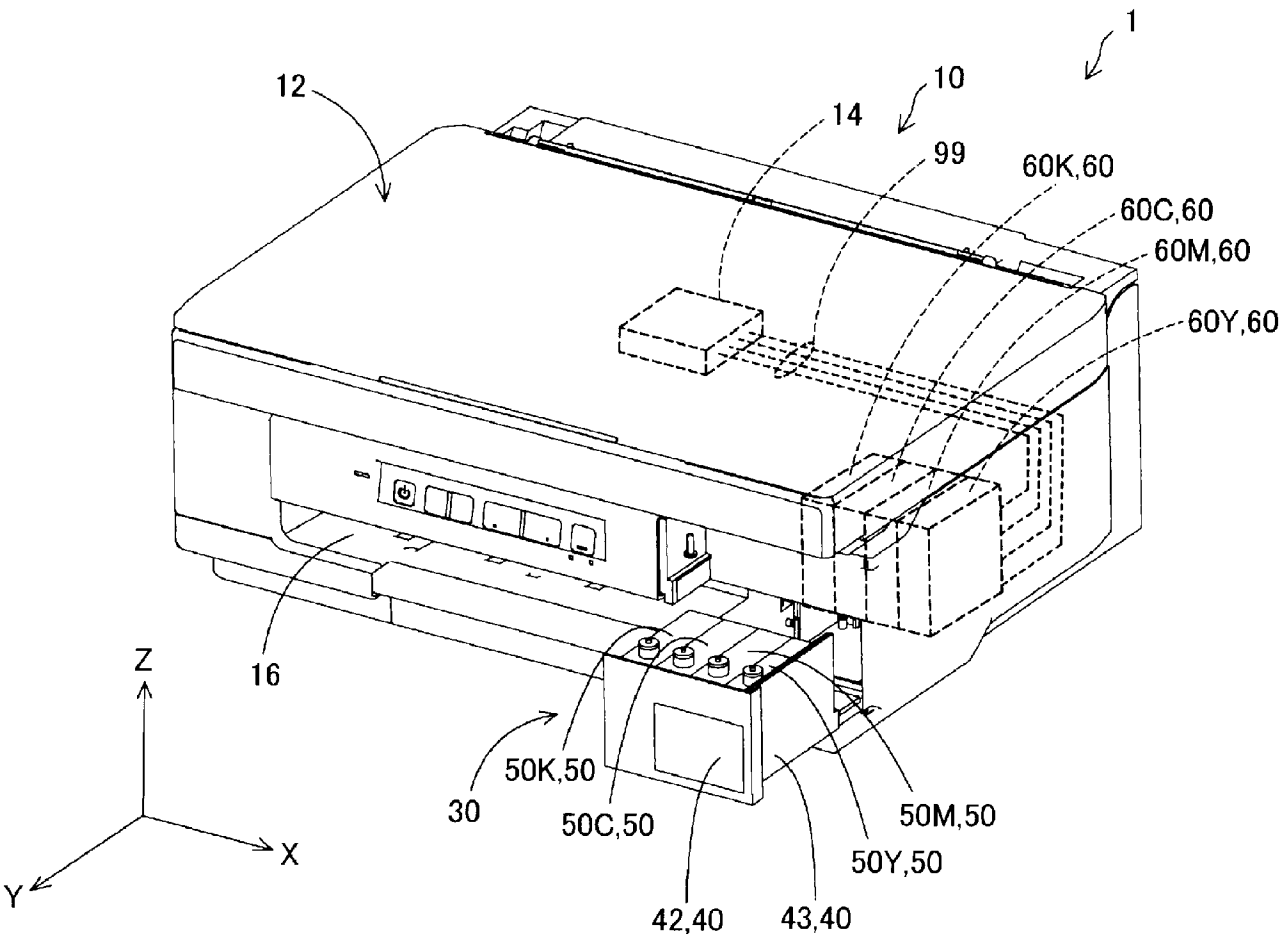
FIG. 2 is a schematic view of a liquid ejection system serving as a first embodiment of the present invention.

FIGS. 1 and 2 are schematic views of a liquid ejection system 1 serving as a first embodiment of the present invention. FIG. 1 shows an external view of the liquid ejection system 1, and FIG. 2 shows an external view and part of an internal structure (indicated by broken lines) of the liquid ejection system 1. The liquid ejection system 1 is provided with a liquid ejection device 10, a liquid storage unit 30 including a liquid storage chamber 50, and an air storage chamber 60. In the present embodiment, the liquid ejection device 10 is an ink jet printer. Below, the liquid ejection device 10 is also referred to as a "printer 10". The liquid storage unit 30 including the liquid storage chamber 50 and the air storage chamber 60 constitutes a liquid supply device 20.

In a usage state of the liquid ejection system 1, the liquid storage chamber 50 of the liquid storage unit 30 is housed inside the printer 10 as shown in FIG. 1. In a liquid replenishment state of the liquid ejection system 1, the liquid storage chamber 50 of the liquid storage unit 30 is exposed to the outside of the printer 10 as shown in FIG. 2. On the other hand, as shown in FIG. 2, the air storage chamber 60 is housed inside the printer 10 regardless of whether the state of the liquid ejection system 1 is the usage state or the liquid replenishment state.

In FIGS. 1 and 2, XYZ axes orthogonal to each other are drawn. The X axis corresponds to a "width direction" of the printer 10, and is parallel to the width direction. Similarly, the Y axis corresponds to a "depth direction" of the printer 10 and is parallel to the depth direction. The Z axis corresponds to a "height direction" of the printer 10 and is parallel to the height direction. In a normal usage state, the printer 10 is installed on a horizontal surface defined by the X axis direction and the Y axis direction. Below, a vertically up direction (a direction on the upper side of a paper face) is also referred to as a +Z axis direction, and a vertically down direction (a direction on the lower side of the paper face) is also referred to as a −Z axis direction. Within the X axis direction, a direction from the left side face to the right side face of the printer 10 is also referred to as a +X axis direction, and the opposite direction to this is also referred to as a −X axis direction. Within the Y axis direction, a direction from the back face to the front face of the printer 10 is also referred to as a +Y axis direction, and the opposite direction to this is also referred to as a −Y axis direction. Note that the XYZ axes of the directions corresponding to FIGS. 1 and 2 are shown also in the drawings from FIG. 3 onward.

The printer 10 is a so-called ink jet printer. The printer 10 prints on a recording medium such as paper by ejecting a liquid as droplets onto the recording medium. The liquid to be ejected is ink. The printer 10 is provided with an operation panel 11 (FIG. 1), a housing 12, a recording head 14 (FIG. 2), and a discharge unit 16.

The housing 12 has an approximately rectangular parallelepiped shape. The housing 12 is provided with a front face (first face) 101 that is an outer wall face of a first wall, a back face (second face) 102 that is an outer wall face of a second wall, a left side face (first side face) 103 that is an outer wall face of a first side wall, a right side face (second side face) 104 that is an outer wall face of a second side wall, a top face (third face) 105 that is an outer wall face of a third wall, and a bottom face (fourth face) 106 that is an outer wall face of a fourth wall. The housing 12, which is an outer shell of the printer 10, is constituted by the six faces 101 to 106. The front face 101 and the back face 102 face each other. Similarly, the left side face 103 and the right side face 104 face each other. The front face 101, the back face 102, the left side face 103, and the right side face 104 are faces approximately perpendicular to the installation surface of the printer 10. The left side face 103 and the right side face 104 respectively intersect the front face 101 and the back face 102. On the other hand, the top face 105 and the bottom face 106 face each other. The top face 105 and the bottom face 106 are approximately horizontal faces. Note that in the present embodiment, "approximately perpendicular" or "approximately horizontal" includes the meaning of being generally "perpendicular" or "horizontal" in addition to the meaning of being completely "perpendicular" or "horizontal". In other words, each of the faces 101 to 106 is permitted to not be a perfect plane and have some unevenness or the like, and it is sufficient that a face is generally "perpendicular" or generally "horizontal" in appearance.

The operation panel 11 and the discharge unit 16 are provided on the front face 101 of the housing 12. The operation panel 11 includes a plurality of buttons that operate each unit of the printer 10, and a display unit that indicates the status of the printer 10. The display unit includes an LED or the like. By operating the operation panel 11, for example, power supply of the printer 10 is switched ON/OFF. The discharge unit 16 discharges a recording medium that has finished printing.

The recording head 14 is provided inside the housing 12. The recording head 14 functions as a liquid ejection unit that ejects ink serving as a liquid in the form of droplets onto a recording medium. The recording head 14 is held by an unshown carriage, and is moved within the interior of the housing 12 in a main scanning direction (the X axis direction) and a sub scanning direction (the Y axis direction). The recording head 14 ejects ink while being moved in the main scanning direction and sub-scanning direction. In the present embodiment, a configuration is adopted in which the recording head 14 is moved in the main scanning direction and the sub scanning direction, but other embodiments can also be adopted. For example, the recording head 14 may be a line head that extends across the entire main scanning direction (the X axis direction) and is moved only in the sub scanning direction (the Y axis direction).

The liquid storage unit 30 is attached to a right side portion (a front face right side 109) of the front face 101 of the housing 12. As shown in FIG. 2, the liquid storage unit 30 is provided with a case 40 and a plurality of liquid storage chambers 50K to 50Y disposed within the case 40. As shown in FIG. 2, the case 40 is configured from two members. The two members are an outside case 42 and an inside case 43. The outside case 42 is a rectangular plate-like member, and supports each liquid storage chamber 50K to 50Y from the +Y axis direction. The inside case 43 has a configuration in which a plate-like member supporting each face in the −Z axis direction of each liquid storage chamber 50K to 50Y, and a plate-like member supporting the face in the +X axis direction of the liquid storage chamber 50Y, are combined in an L shape. In the usage state shown in FIG. 1, only the outside case 42 is exposed to the outside. In the liquid replenishment state shown in FIG. 2, the liquid storage unit 30 is pulled out to the outside together with the case 40 by an unshown slide mechanism attached to the bottom face of the case 40. Therefore, in the liquid replenishment state shown in FIG. 2, both the outside case 42 and the inside case 43 are exposed to the outside.

In the liquid replenishment state shown in FIG. 2, each of the liquid storage chambers 50K to 50Y is disposed in a line in the X axis direction in a state supported by the case 40. The liquid storage chamber 50K stores black ink. Similarly, the liquid storage chamber 50C stores cyan ink, the liquid storage chamber 50M stores magenta ink, and the liquid storage chamber 50Y stores yellow ink. The liquid storage chambers 50K to 50Y are respectively connected to corresponding air storage chambers 60K to 60Y through a first hose 95 and a second hose 96 (not shown in FIGS. 1 and 2), described later.

The air storage chambers 60K to 60Y are respectively connected to the recording head 14 through corresponding flow pipes 99. Each flow pipe 99 is, for example, a tube molded from a flexible resin member (for example, rubber). Ink of each color stored in the liquid storage chambers 50K to 50Y is respectively supplied to the recording head 14, by a supply mechanism such as a pump provided in the printer 10, through a liquid supply flow path (described in detail later) within each of the air storage chambers 60K to 60Y, and the flow pipes 99. That is, the liquid storage chambers 50K to 50Y can store ink to be supplied to the recording head 14 as a liquid ejection unit.

Hereinafter, in descriptions when distinguishing between the liquid storage chambers 50K to 50Y, a letter is affixed when referring to a liquid storage chamber, for example "the liquid storage chamber 50K" or the like, and in descriptions when not distinguishing between the liquid storage chambers 50K to 50Y, they are referred to as simply a "liquid storage chamber 50". Likewise, in descriptions when distinguishing between the air storage chambers 60K to 60Y, a letter is affixed when referring to an air storage chamber, and in descriptions when not distinguishing between the air storage chambers 60K to 60Y, they are referred to as simply an "air storage chamber 60". Note that an example of four of the liquid storage chambers 50 is given as the quantity of the liquid storage chambers 50, but the quantity of the liquid storage chambers 50 is not limited to this. For example, the quantity of the liquid storage chambers 50 can be set to an arbitrary number of one or more. In this case, the quantity of the air storage chambers 60 is set the same as the quantity of the liquid storage chambers 50.

In the present embodiment, the X axis direction is also referred to as the "width direction" of the liquid storage unit 30 and the liquid storage chamber 50. Similarly, the Y axis direction is also referred to as the "depth direction" of the liquid storage unit 30 and liquid storage chamber 50, and the Z axis direction is also referred to as the "height direction" of the liquid storage unit 30 and liquid storage chamber 50.

A-2. Configuration of Liquid Supply Device

Next is a description of the configuration of the liquid supply device 20, and the configuration of the liquid storage unit 30 and the air storage chamber 60 used to configure the liquid supply device 20.

Figure 3:
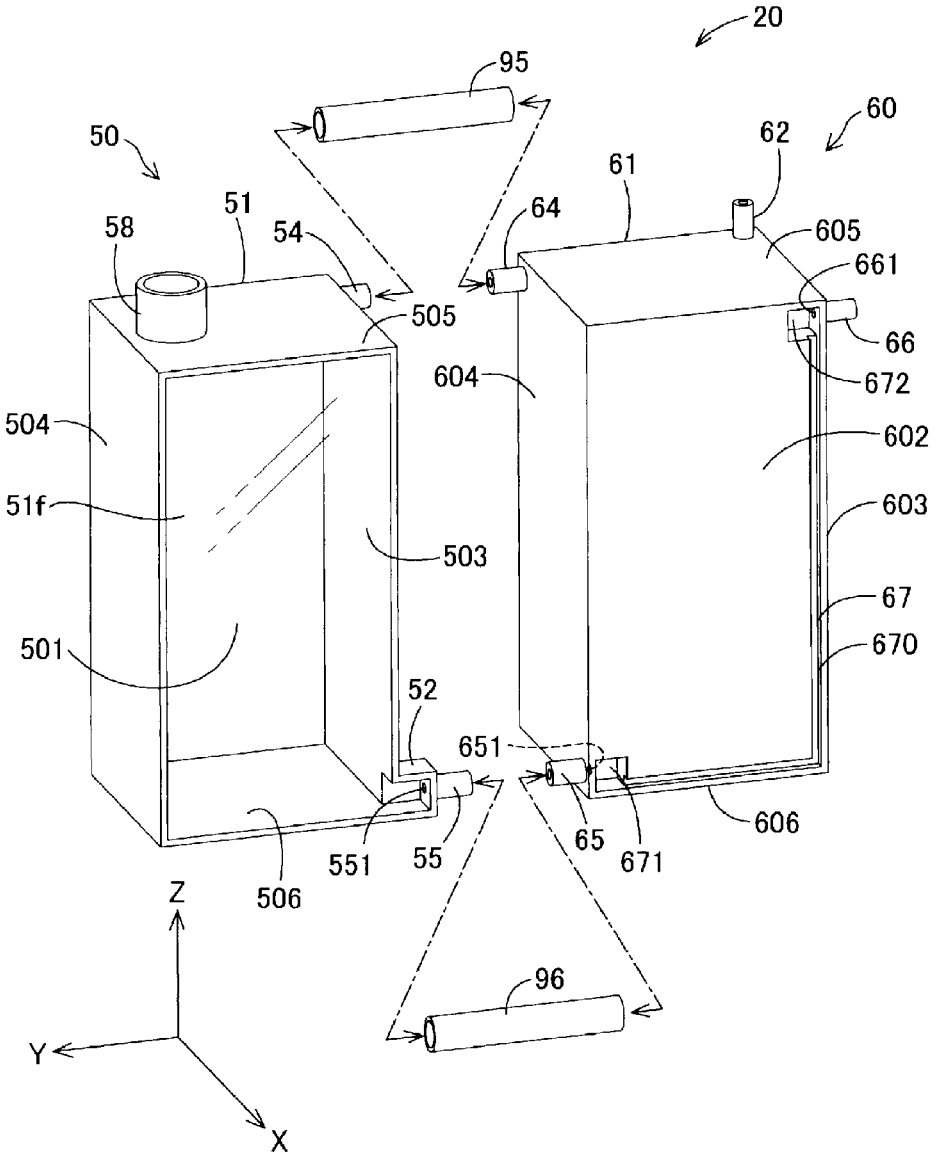
FIG. 3 shows a schematic configuration of a liquid supply device viewed from a first direction.
Figure 4:
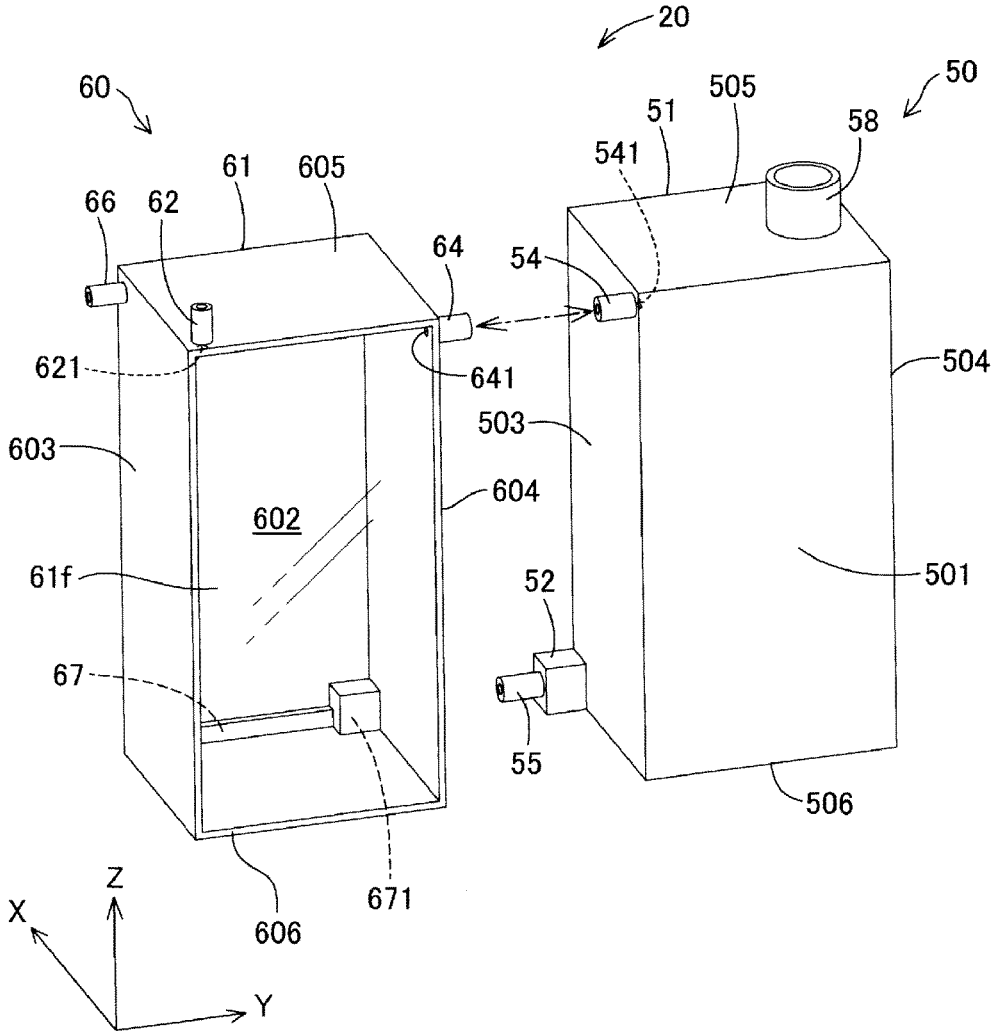
FIG. 4 shows a schematic configuration of a liquid supply device viewed from a second direction.

FIG. 3 shows the schematic configuration of the liquid supply device 20 viewed from a first direction. FIG. 4 shows the schematic configuration of the liquid supply device 20 viewed from a second direction. As described above, the liquid supply device 20 of the present embodiment is provided with the liquid storage chamber 50 and the air storage chamber 60. The liquid storage chamber 50 and the air storage chamber 60 are connected by the first hose 95 and the second hose 96. For convenience of illustration, the first hose 95 and the second hose 96 are not shown in FIG. 4.

The liquid storage chamber 50 is provided with a main body 51, a protruding portion 52, a first opening member 54, a second opening member 55, and a liquid injection portion 58.

The main body 51 is a member having a hollow and approximately columnar shape. The main body 51 is provided with a first wall 501 (FIG. 4), a first side wall 503 (FIG. 3), a second side wall 504 (FIG. 3), a third wall 505 (FIGS. 3 and 4), and a fourth wall 506. The outer wall face of the first wall 501 is referred to as a "front face" or a "first face". The outer wall face of the first side wall 503 is referred to as a "left side face" or a "first side face". The outer wall face of the second side wall 504 is referred to as a "right side face" or a "second side face". The outer wall face of the third wall 505 is referred to as a "top face" or a "third face". The outer wall face of the fourth wall 506 is referred to as a "bottom face" or a "fourth face". In the main body 51, the face on the side facing the front face of the first wall 501 is an open face. This open face is blocked by a sheet member 51*f* (a film member). In the main body 51, the inside and the outside of the liquid storage chamber 50 are defined by the walls 501 and 503 to 506, and the sheet member 51*f*. The first side wall 503 and the second side wall 504 face each other. The respective outer wall faces of the first wall 501, the first side wall 503, and the second side wall 504 are faces approximately perpendicular to the installation surface of the printer 10. The third wall 505 and the fourth wall 506 face each other. The top face of the third wall 505 and the bottom face of the fourth wall 506 each are approximately horizontal faces.

In the main body 51, an opening having a size corresponding to the inner dimension of the protruding portion 52 is formed at a position where the protruding portion 52 is disposed. Also, in the main body 51, at positions corresponding to the position where the first opening member 54 is disposed and the position where the liquid injection portion 58 is disposed, openings having a size corresponding to the openings of the respective portions 54 and 58 are formed. The main body 51 is molded from a synthetic resin such as polypropylene, for example. Also, the main body 51 is translucent. As described above, the inside space of the main body 51 functions as a liquid storage chamber that stores ink. Therefore, when replenishing liquid into the liquid storage chamber 50, a user can confirm the liquid level of ink in the liquid storage chamber 50 within the main body 51 from the outside.

The protruding portion 52 is connected so as to protrude in the −Y axis direction at one end on the lower side in the vertical direction of the first side wall 503 of the main body 51. The protruding portion 52 is a member having a hollow and approximately columnar shape, and a connecting face with the main body 51 is an open face with an opening. Also, in the protruding portion 52, an opening having a size corresponding to the opening of the second opening member 55 is formed at the position where the second opening member 55 is disposed. The protruding portion 52 is molded from a synthetic resin, similar to the main body 51. The protruding portion 52 may also be molded as a single body together with the main body 51.

The first opening member 54 is a cylindrically shaped member having both ends open. The first opening member 54 is disposed to the outside of the main body 51 at one end on the upper side in the vertical direction of the first side wall 503 of the main body 51. The first opening member 54 is molded from a synthetic resin, similar to the main body 51. The first opening member 54 may also be molded as a single body together with the main body 51. An air introduction port 541 (FIG. 4), which is an opening at one end of the first opening member 54, is in communication with the inside of the liquid storage chamber 50 through an opening of the main body 51. An opening at the other end of the first opening member 54 is in communication with the interior of the air storage chamber 60 through the first hose 95 (FIG. 3).

The second opening member 55 is a cylindrically shaped member having both ends open. The second opening member 55 is disposed to the outside relative to the face on the side facing the air storage chamber 60, within the protruding portion 52. The second opening member 55 is molded from a synthetic resin, similar to the main body 51 and the protruding portion 52. The second opening member 55 may also be molded as a single body together with the main body 51 or the protruding portion 52. A liquid outlet port 551 (FIG. 3), which is an opening at one end of the second opening member 55, is in communication with the inside of the liquid storage chamber 50 through an opening of the protruding portion 52. An opening at the other end of the second opening member 55 is connected to a liquid supply flow path 67 of the air storage chamber 60 through the second hose 96 (FIG. 3).

The liquid injection portion 58 is a cylindrically shaped member having both ends open. The cross-sectional area of the opening of the liquid injection portion 58 is designed to be somewhat large in consideration of convenience when injecting liquid. The liquid injection portion 58 is disposed to the outside of the main body 51 at a predetermined position of the third wall 505. In the present embodiment, the predetermined position is set as the end in the +Y axis direction. The liquid injection portion 58 is molded from a synthetic resin, similar to the main body 51. The liquid injection portion 58 may also be molded as a single body together with the main body 51. An opening at one end of the liquid injection portion 58 is in communication with the opening of the main body 51, and an opening at the other end of the liquid injection portion 58 is in communication with the atmosphere. The liquid injection portion 58 is blocked by an unshown plug member, except when injecting liquid. The plug member is molded from a flexible resin member (for example, rubber).

The air storage chamber 60 has a main body 61, a first opening member 62, a second opening member 64, a third opening member 65, a fourth opening member 66, and the liquid supply flow path 67.

The main body 61 is a member having a hollow and approximately columnar shape. The main body 61 is provided with a second wall 602 (FIG. 3), a first side wall 603 (FIG. 4), a second side wall 604 (FIG. 3), a third wall 605 (FIGS. 3 and 4), and a fourth wall 606. The outer wall face of the second wall 602 is referred to as a "back face" or a "second face". The outer wall face of the first side wall 603 is referred to as a "left side face" or a "first side face". The outer wall face of the second side wall 604 is referred to as a "right side face" or a "second side face". The outer wall face of the third wall 605 is referred to as a "top face" or a "third face". The outer wall face of the fourth wall 606 is referred to as a "bottom face" or a "fourth face". The face on the side facing the back face of the main body 61 is an open face having an opening. This opening face is blocked by a sheet member 61*f* (a film member). In the main body 61, the inside and the outside of the air storage chamber 60 are defined by the walls 602 to 606, and the sheet member 61*f*. The first side wall 603 and the second side wall 604 face each other. The respective outer wall faces of the second wall 602, the first side wall 603, and the second side wall 604 are faces approximately perpendicular to the installation surface of the printer 10. The third wall 605 and the fourth wall 606 face each other. The top face of the third wall 605 and the bottom face of the fourth wall 606 each are approximately horizontal faces.

In the main body 61, at positions where the first opening member 62, the second opening member 64, the third opening member 65, and the fourth opening member 66 are disposed, openings having a size corresponding to the openings of the respective portions 62, 64, 65, and 66 are formed. The main body 61 is molded from a synthetic resin such as polypropylene, for example.

The first opening member 62 is a cylindrically shaped member having both ends open. The first opening member 62 is disposed to the outside of the main body 61 at one end of the third wall 605 of the main body 61. The first opening member 62 is molded from a synthetic resin, similar to the main body 61. The first opening member 62 may also be molded as a single body together with the main body 61. An atmosphere opening port 621 (FIG. 4), which is an opening at one end of the first opening member 62, is in communication with the inside of the air storage chamber 60 through an opening of the main body 61. An opening at the other end of the first opening member 62 is in communication with the atmosphere.

The second opening member 64 is a cylindrically shaped member having both ends open. In the present embodiment, the second opening member 64 is disposed to the outside of the main body 61, at a position on the upper side in the vertical direction of the second side wall 604 and facing the first opening member 54 of the liquid storage chamber 50. The second opening member 64 is molded from a synthetic resin, similar to the main body 61. The second opening member 64 may also be molded as a single body together with the main body 61. A liquid chamber side opening 641 (FIG. 4), which is an opening at one end of the second opening member 64, is in communication with the inside of the air storage chamber 60 through an opening of the main body 61. An opening at the other end of the second opening member 64 is in communication with the inside of the liquid storage chamber 50 through the first hose 95 (FIG. 3). In the present embodiment, the liquid chamber side opening 641 of the air storage chamber 60 and the air introduction port 541 of the liquid storage chamber 50 are disposed at positions facing each other.

The third opening member 65 is a cylindrically shaped member having both ends open. In the present embodiment, the third opening member 65 is disposed to the outside of the main body 61, at a position on the lower side in the vertical direction of the second side wall 604 and facing the second opening member 55 of the liquid storage chamber 50. The third opening member 65 is molded from a synthetic resin, similar to the main body 61. The third opening member 65 may also be molded as a single body together with the main body 61. A liquid introduction port 651 (FIG. 3), which is an opening at one end of the third opening member 65, is in communication with a first buffer chamber 671. An opening at the other end of the third opening member 65 is in communication with the inside of the liquid storage chamber 50 through the second hose 96 (FIG. 3). In the present embodiment, the liquid introduction port 651 of the air storage chamber 60 and the liquid outlet port 551 of the liquid storage chamber 50 are disposed at positions facing each other.

The fourth opening member 66 is a cylindrically shaped member having both ends open. The fourth opening member 66 is disposed to the outside of the main body 61, at one end on the upper side in the vertical direction of the first side wall 603. The fourth opening member 66 is molded from a synthetic resin, similar to the main body 61. The fourth opening member 66 may also be molded as a single body together with the main body 61. A liquid outlet port 661 (FIG. 3), which is an opening at one end of the fourth opening member 66, is in communication with a second buffer chamber 672. An opening at the other end of the fourth opening member 66 is connected to the recording head 14 through the flow pipe 99 (FIG. 2).

The liquid supply flow path 67 is a flow path that supplies ink from the liquid storage chamber 50 to the recording head 14. The liquid supply flow path 67 is formed, in a wall of the main body 61, in a face on the opposite side as the inside of the air storage chamber 60. Specifically, the liquid supply flow path 67 of the present embodiment is defined in the second wall 602 of the main body 61, by a groove 670 (FIG. 3) recessed inside of the air storage chamber 60 from the face on the opposite side as the inside of the air storage chamber 60, and a sheet member (film member) that blocks the groove 670. The liquid supply flow path 67 is embedded in the second wall 602. In the present embodiment, the groove 670 constituting the liquid supply flow path 67 is formed in the second wall 602 of the main body 61 so as to protrude inside of the air storage chamber 60 (FIG. 4). The shape of the liquid supply flow path 67 of the present embodiment is an approximately L shape extending from a corner on the lower side in the vertical direction to a corner on the upper side in the vertical direction of the second wall 602 of the main body 61 (FIG. 3).

The first buffer chamber 671, which is a recessed portion having an opening area larger than other parts of the groove 670 of the liquid supply flow path 67, is formed at one end on the lower side in the vertical direction of the liquid supply flow path 67. Similar to other parts of the groove 670 of the liquid supply flow path 67, the first buffer chamber 671 is recessed inside of the air storage chamber 60 from the face on the opposite side as the inside of the air storage chamber 60 (FIG. 3). In the first buffer chamber 671, an opening in communication with the liquid introduction port 651 is formed. The second buffer chamber 672, which is a recessed portion having an opening area larger than other parts of the groove 670 of the liquid supply flow path 67, is formed at the other end on the upper side in the vertical direction of the liquid supply flow path 67. Similar to other parts of the groove 670 of the liquid supply flow path 67, the second buffer chamber 672 is recessed inside of the air storage chamber 60 from the face on the opposite side as the inside of the air storage chamber 60 (FIG. 3). In the second buffer chamber 672, an opening in communication with the liquid outlet port 661 is formed.

In this way, according to the liquid supply device 20 of the present embodiment and the liquid storage unit 30 and the air storage chamber 60 constituting the liquid supply device 20, the liquid supply flow path 67 is formed recessed inside of the air storage chamber 60, and does not protrude outside. Therefore, the external shape of the air storage chamber 60 including the liquid supply flow path 67 can be simplified, and the air storage chamber 60 is reduced in size.

The first hose 95 and the second hose 96 are tubes having a cylindrical shape with both ends open, molded from a flexible resin member (for example, rubber). The first hose 95 and the second hose 96 are longer than the distance between the liquid storage chamber 50 and the air storage chamber 60 in the liquid replenishment state shown in FIG. 2 (the shortest length between the positions where both the liquid storage chamber 50 and the air storage chamber 60 are disposed).

A-3. Atmospheric Release Flow Path and Liquid Supply Flow Path

The flow of the atmosphere using an atmospheric release flow path in the liquid supply device 20, and the liquid storage unit 30 and the air storage chamber 60 constituting the liquid supply device 20, will now be described. One end of the atmospheric release flow path is the atmosphere opening port 621 of the air storage chamber 60 and the other end is the air introduction port 541 of the liquid storage chamber 50. Through the atmosphere opening port 621 which is one end of the atmospheric release flow path, the air storage chamber 60 is in communication with the atmosphere and air is introduced into the air storage chamber 60. Air that has been introduced into the air storage chamber 60 is introduced into the liquid storage chamber 50 through the liquid chamber side opening 641 of the air storage chamber 60 and the inside of the first hose 95. Air that has been introduced into the liquid storage chamber 50 is taken inside the liquid storage chamber 50 from the air introduction port 541, which is the other end of the atmospheric release flow path.

The flow of ink using a liquid supply flow path in the liquid supply device 20, and the liquid storage unit 30 and the air storage chamber 60 constituting the liquid supply device 20, will now be described. One end of the liquid supply flow path is the liquid outlet port 551 of the liquid storage chamber 50 and the other end is the liquid outlet port 661 of the air storage chamber 60 (FIG. 3). Ink accumulated within the liquid storage chamber 50 is let out from the liquid outlet port 551, which is one end of the liquid supply flow path. The ink let out from the liquid storage chamber 50 is introduced into the first buffer chamber 671 of the air storage chamber 60 through the inside of the second hose 96 and the liquid introduction port 651 of the air storage chamber 60. The ink introduced to the first buffer chamber 671 passes through the liquid supply flow path 67 and is led to the second buffer chamber 672. The ink introduced into the second buffer chamber 672 is led from the liquid outlet port 661, which is the other end of the liquid supply flow path, to the flow pipe 99 (FIG. 2) connected to the recording head 14.

Note that as described with reference to FIG. 2, in the liquid ejection system 1 of the present embodiment, replenishment of ink is performed with the liquid storage unit 30 pulled out. Therefore, in the liquid supply device of the present embodiment, the attitudes of the liquid storage chamber 50 and the air storage chamber 60 are constant, and their attitudes are as shown in FIGS. 3 and 4 regardless of whether in the usage state or the liquid replenishment state. Note that when the liquid storage unit 30 has been pulled out, the interval between the liquid storage chamber 50 and the air storage chamber 60 changes, but this interval change is not included in a change in attitude.

As described above, according to the liquid supply device 20 of the first embodiment, and the liquid storage unit 30 and the air storage chamber 60 constituting this liquid supply device 20, the liquid supply flow path 67, which is the flow path where liquid is supplied from the liquid storage chamber 50 to the recording head 14, is formed in a wall defining the air storage chamber 60 (in the case of the above embodiment, the second wall 602 of the main body 61). Therefore, in the liquid supply device 20 of the present embodiment, in comparison to a configuration in which the ink tube forming the liquid supply flow path and the air storage chamber 60 are each separately provided, the space necessary in order to provide the liquid supply flow path can be reduced, and so the size of the liquid supply device can be reduced.

Also, according to the liquid supply device 20 of the above embodiment, and the liquid storage unit 30 and the air storage chamber 60 constituting this liquid supply device 20, the liquid introduction port 651 that is an opening on one end of the liquid supply flow path 67 provided in the air storage chamber 60 and the liquid outlet port 551 provided in the liquid storage chamber 50 are in positions facing each other, so as is clear from FIG. 3, the liquid introduction port 651 and the liquid outlet port 551 can be connected in approximately a straight line. As a result, it is possible to easily connect the air storage chamber 60 and the liquid storage chamber 50. Also, in comparison to a case where the liquid introduction port 651 and the liquid outlet port 551 are not in positions facing each other, the space necessary in order to dispose the second hose 96 serving as a connecting member can be reduced, and so the size of the liquid supply device can be reduced.

Further, according to the liquid supply device 20 of the above embodiment, and the liquid storage unit 30 and the air storage chamber 60 constituting this liquid supply device 20, the air introduction port 541 provided in the liquid storage chamber 50 and the liquid chamber side opening 641 that is an opening provided in the air storage chamber 60 are in positions facing each other, so as is clear from FIG. 3, the air introduction port 541 and the liquid chamber side opening 641 can be connected in approximately a straight line. As a result, it is possible to easily connect the air storage chamber 60 and the liquid storage chamber 50. Also, in comparison to a case where the air introduction port 541 and the liquid chamber side opening 641 are not in positions facing each other, the space necessary in order to dispose the first hose 95 serving as a connecting member can be reduced, and so the size of the liquid supply device 20 can be reduced.

Further, according to the liquid supply device 20 of the above embodiment, and the liquid storage unit 30 and the air storage chamber 60 constituting this liquid supply device 20, the liquid outlet port 661 that is the opening at the other end of the liquid supply flow path 67 of the air storage chamber 60 is provided at the upper end in the vertical direction of the air storage chamber 60, so the liquid supply flow path 67 can be raised toward the upper side on the wall defining the air storage chamber 60 (FIG. 3). As a result, in a configuration in which the recording head 14 is disposed above the air storage chamber 60 in the vertical direction, liquid that has been let out from the liquid supply flow path 67 can be smoothly sent toward the recording head 14.

Further, according to the liquid supply device 20 of the above embodiment, and the liquid storage unit 30 and the air storage chamber 60 constituting this liquid supply device 20, the air storage chamber 60 includes the main body 61 that is a housing that has an open face and forms an air chamber, and the sheet member **61*f* that is a first sealing member that seals the open face. Also, the liquid supply flow path 67 of the air storage chamber 60 includes the groove 670 formed so as to protrude toward the inside of the air chamber in the wall of the main body 61, and the sheet member that is a second sealing member that seals the groove 670. Therefore, according to the liquid supply device of the present embodiment, it is possible to simplify the external shape of the air storage chamber 60 including the liquid supply flow path 67, and also possible to easily manufacture the air storage chamber 60 and the liquid supply flow path 67** using the sealing members.

A-4. Other Exemplary Configurations of Liquid Supply Device

The configurations of the liquid supply device 20 of the first embodiment described above and the liquid storage unit 30 and the air storage chamber 60 constituting this liquid supply device 20 are merely examples, and various modifications are possible. Other exemplary configurations of the liquid supply device 20 of the first embodiment will be described below. Note that in the drawings, similar configurations and operations as those of the first embodiment are denoted by similar reference signs as previously described in the first embodiment, and a detailed description thereof will be omitted here.

A-4-1. First Exemplary Configuration

Figure 5:
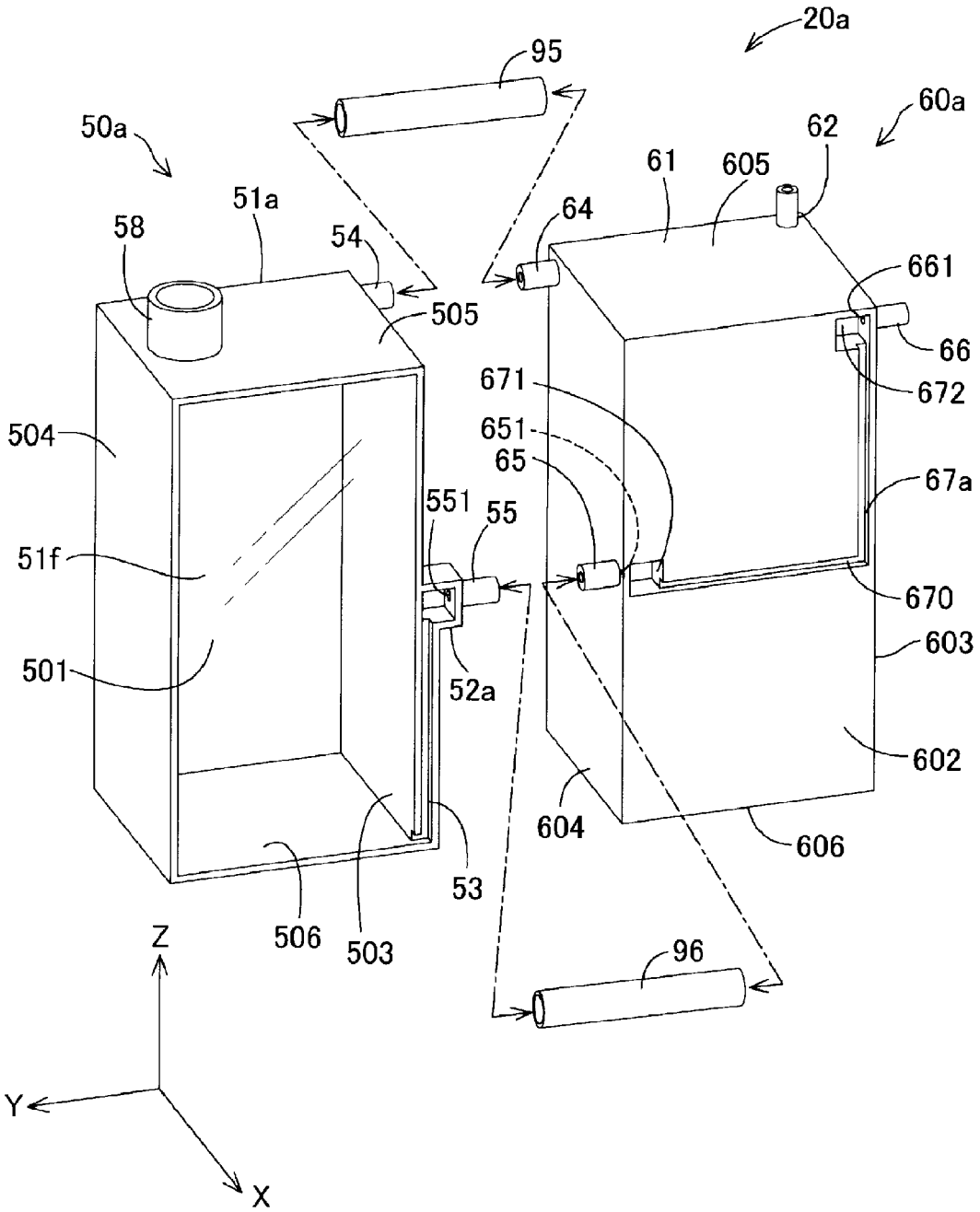
FIG. 5 shows a schematic configuration of a liquid supply device of a first exemplary configuration.
Figure 6:
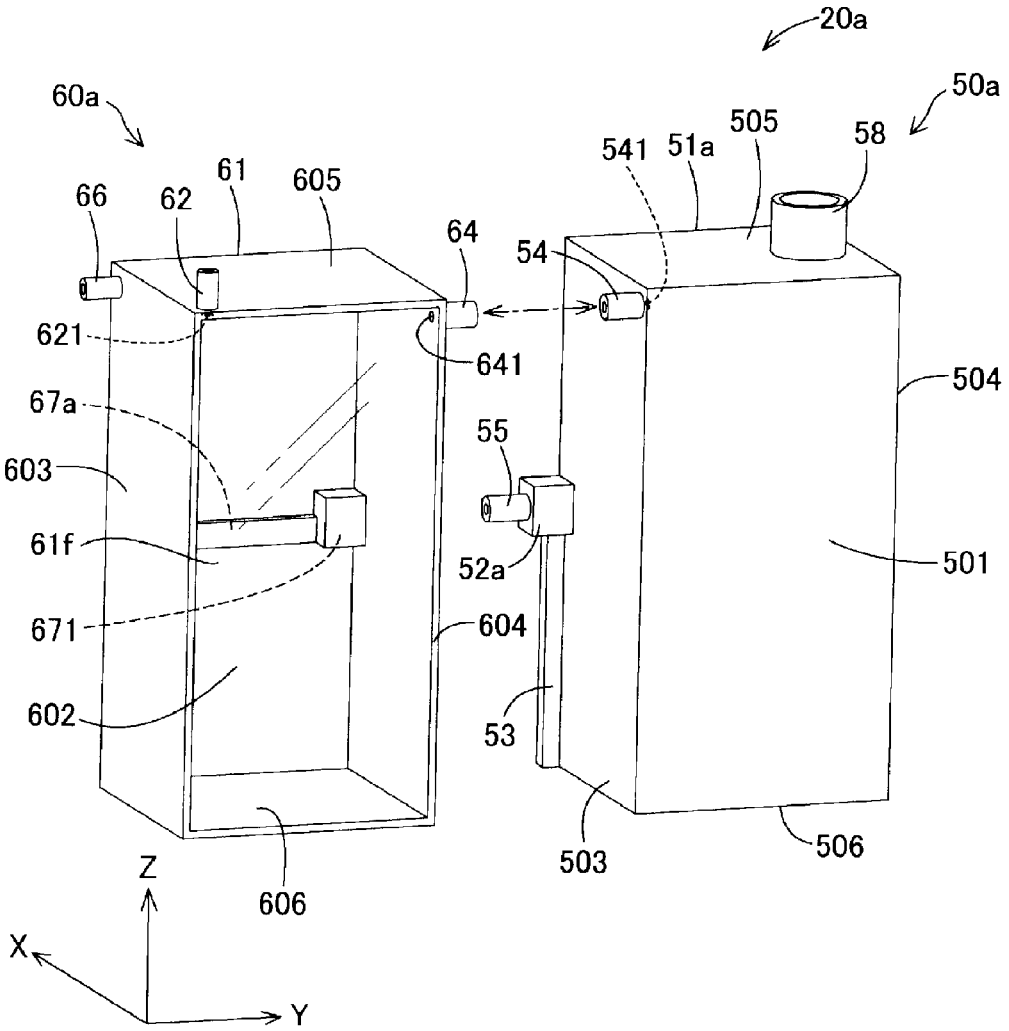
FIG. 6 shows a schematic configuration of a liquid supply device of a first exemplary configuration.

A first exemplary configuration that is one variation of the liquid supply device 20 of the first embodiment will now be described with reference to FIGS. 5 and 6. FIG. 5 shows a schematic configuration of a liquid supply device **20*a* of the first exemplary configuration viewed from a first direction. FIG. 6 shows a schematic configuration of the liquid supply device 20*a* of the first exemplary configuration viewed from a second direction. The differences from the liquid supply device 20 of the first embodiment shown in FIGS. 3 and 4 are that a liquid storage chamber 50*a* is provided instead of the liquid storage chamber 50, and an air storage chamber 60*a* is provided instead of the air storage chamber 60. For convenience of illustration, the first hose 95 and the second hose 96 are not shown in FIG. 6**.

The differences between the liquid storage chamber **50*a* and the liquid storage chamber 50 (FIG. 3) are that a main body 51*a* is provided instead of the main body 51, a protruding portion 52*a* is provided instead of the protruding portion 52, and also, a liquid supply flow path 53 is provided. In the main body 51*a*, an opening having a size corresponding to the inner diameter of the liquid supply flow path 53 is formed at a position where one end of the liquid supply flow path 53 is connected (in the present embodiment, one end at the lower side in the vertical direction), instead of the position where the protruding portion 52*a* is disposed. Other configurations of the main body 51*a* are the same as the main body 51**.

The liquid supply flow path 53 is a flow path that supplies ink from the liquid storage chamber 50 to the air storage chamber 60. The liquid supply flow path 53 is formed, in a wall of the main body **51*a*, in a face on the opposite side as the inside of the liquid storage chamber 50. Specifically, the liquid supply flow path 53 of the present embodiment is defined in the first side wall 503 of the main body 51*a* by a groove 670 (FIGS. 5 and 6) formed so as to open in the +X axis direction in a part that protrudes toward the outside from the face on the opposite side as the inside of the liquid storage chamber 50, and a sheet member (film member) that blocks the groove 670. The shape of the liquid supply flow path 53 of the present embodiment is approximately I-shaped extending from a corner on the lower side in the vertical direction of the first side wall 503 of the main body 51***a* toward approximately a center portion in the vertical direction. One end on the lower side in the vertical direction of the liquid supply flow path 53, as described above, is in communication with the opening of the main body 51*a*. The protruding portion 52*a* is connected to the other end in approximately the center portion in the vertical direction of the liquid supply flow path 53. Other configurations of the protruding portion 52*a* are the same as the protruding portion 52.

Note that the second opening member 55 is disposed in the protruding portion 52*a*. Therefore, in the example of the present embodiment, the second opening member 55 protrudes outside in approximately the center portion in the vertical direction of the first side wall 503 of the main body 51*a*, similar to the protruding portion 52*a*.

The difference between the air storage chamber 60*a* and the air storage chamber 60 (FIG. 3) is only that a liquid supply flow path 67*a* is provided instead of the liquid supply flow path 67. The liquid supply flow path 67*a* is approximately L-shaped extending from approximately the center portion in the vertical direction of the second wall 602 of the main body 61 (in other words, a portion facing the second opening member 55) to a corner portion on the upper side in the vertical direction. The first buffer chamber 671 is formed at one end in approximately the center portion in the vertical direction of the liquid supply flow path 67*a*, and the second buffer chamber 672 is formed at the other end on the upper side in the vertical direction. Other configurations of the liquid supply flow path 67*a*, the first buffer chamber 671, and the second buffer chamber 672 are the same as those of the above-described liquid supply flow path 67 and the like.

Note that the third opening member 65 is disposed at a position facing the second opening member 55 of the liquid storage chamber 50. Therefore, in the example of the present embodiment, the third opening member 65 protrudes outside from approximately the center portion in the vertical direction of the second side wall 604 of the main body 61, similar to the second opening member 55.

The atmospheric flow using the atmospheric release flow path in the liquid storage unit 30 and the air storage chamber 60*a* of the liquid supply device 20*a* of the first exemplary configuration, and the ink flow using the liquid supply flow path 67*a*, are similar to those of the liquid supply device 20 in the first embodiment. The same effects as described in the first embodiment can also be achieved in the liquid supply device 20*a* of the first exemplary configuration.

A-4-2. Second Exemplary Configuration

Figure 7:
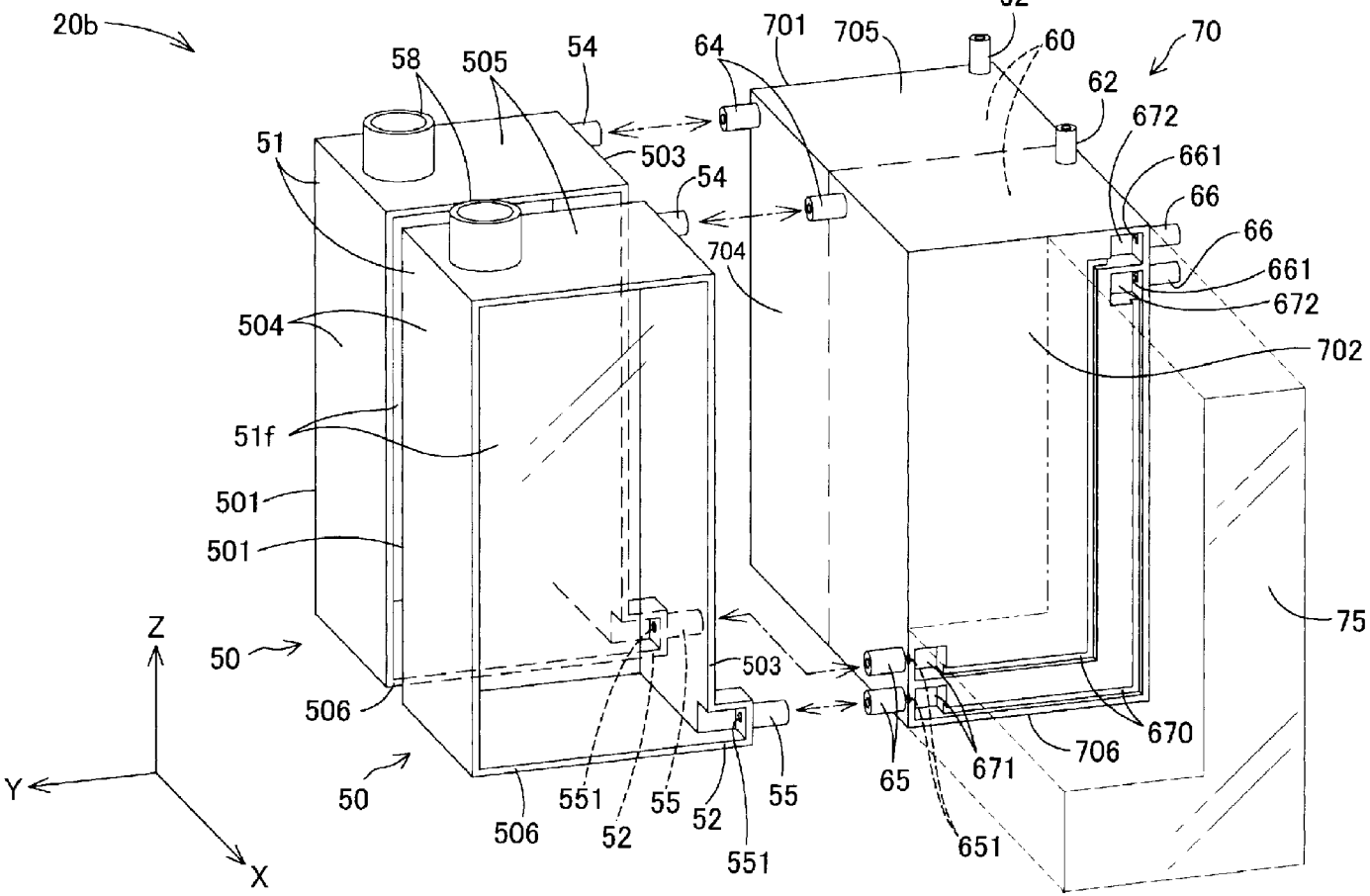
FIG. 7 is a first schematic perspective view showing a liquid supply device of a second exemplary configuration.
Figure 8:
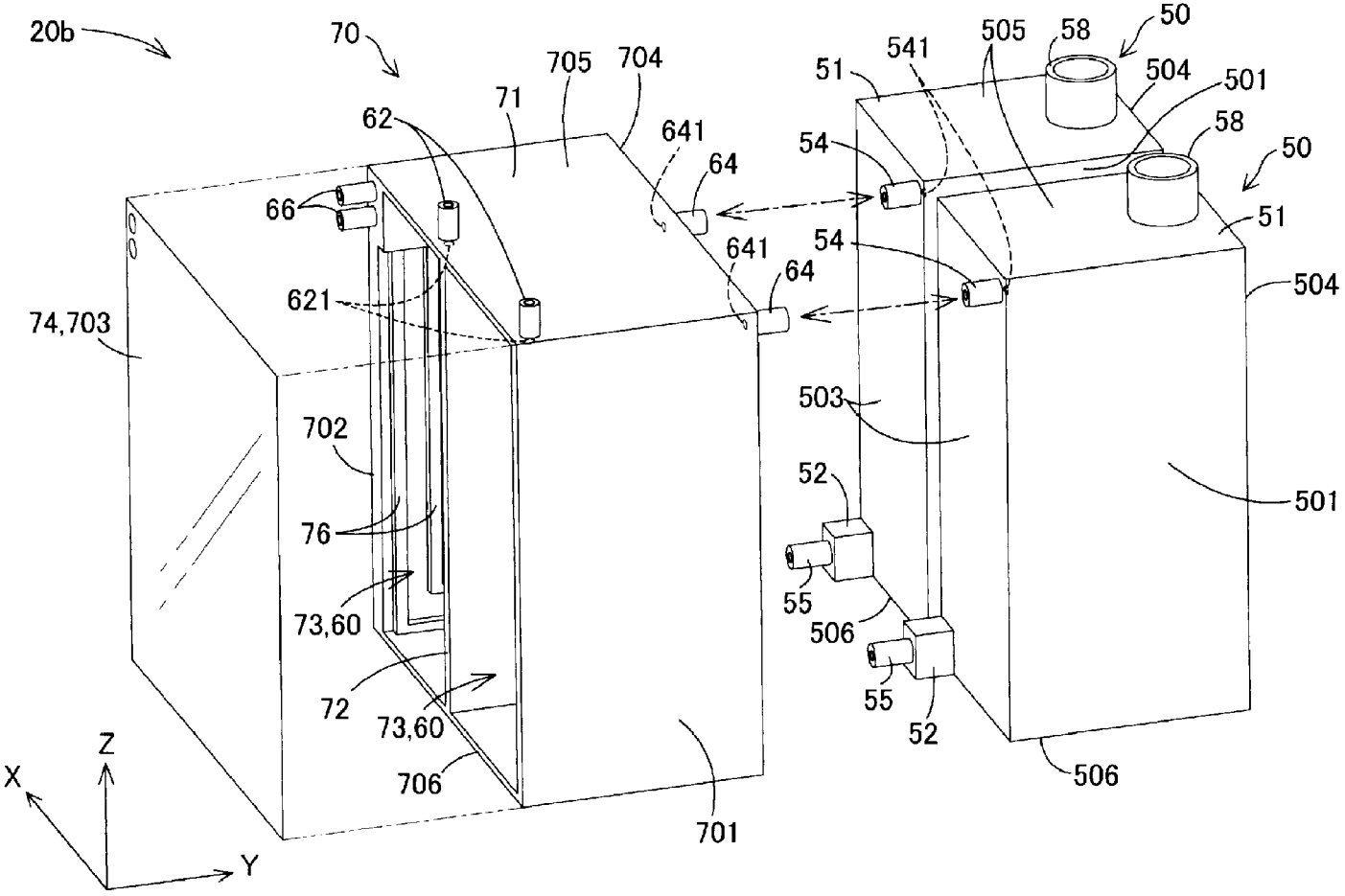
FIG. 8 is a second schematic perspective view showing a liquid supply device of a second exemplary configuration.

A liquid supply device 20*b* of a second exemplary configuration that is one variation of the liquid supply device 20 of the first embodiment will now be described with reference to FIGS. 7 and 8. FIG. 7 is a schematic perspective view showing the liquid supply device 20*b* of the second exemplary configuration, viewed from the +X axis direction side and the +Y axis direction side. FIG. 8 is a schematic perspective view showing the liquid supply device 20*b* of the second exemplary configuration, viewed from the −X axis direction side and the −Y axis direction side. The liquid supply device 20*b* of the second exemplary configuration mainly differs from the liquid supply device 20 of the first embodiment in that the liquid supply device 20*b* is provided with an air storage body 70, and otherwise has approximately the same configuration as the liquid supply device 20 of the first embodiment.

The liquid supply device 20*b* of the second exemplary configuration is provided with a plurality of liquid storage chambers 50 and the air storage body 70 (FIGS. 7 and 8). In the air storage body 70, a plurality of the air storage chambers 60 are integrated. The air storage body 70 is a hollow member, and its internal space constitutes a plurality of the air storage chambers 60. In the air storage body 70 of the second exemplary configuration, two of the air storage chambers 60, configured to be connected to two liquid storage chambers 50 arranged adjacent to each other in the X axis direction, are integrated. In FIG. 7, a position where the two air storage chambers 60 are partitioned by a partition wall 72 (FIG. 8) is indicated by a broken line.

The liquid supply device 20*b* of the second exemplary configuration is provided with a plurality of air storage bodies 70. The liquid supply device 20*b* has two air storage bodies 70 for the four liquid storage chambers 50C, 50M, 50Y, and 50K. A first air storage body 70 has a pair of air storage chambers 60K and 60C configured to be connected to the pair of liquid storage chambers 50K and 50C. A second air storage body 70 has a pair of air storage chambers 60M and 60Y configured to be connected to the pair of liquid storage chambers 50M and 50Y. Note that the quantity of air storage chambers 60 that can be integrated in the air storage body 70 is not limited to two. In the air storage body 70, an arbitrary quantity of two or more air storage chambers 60 may be integrated.

In the liquid supply device 20*b* of the second exemplary configuration, each air storage chamber 60 of the air storage body 70 is connected to one of the corresponding liquid storage chambers 50, and an independent air storage chamber 60 is connected to each of the plurality of liquid storage chambers 50. The air storage chambers 60 have a function of accumulating liquid that leaked to the outside of the liquid storage chambers 50 through the air introduction port 541, when the printer 10 has been disposed inclined relative to its attitude in the normal usage state. If an independent air storage chamber 60 is provided for each liquid storage chamber 50 as in the liquid supply device 20*b* of the second exemplary configuration, liquid that has flowed out from each liquid storage chamber 50 can be suppressed from mixing together in the air storage chamber 60. Therefore, in the printer 10, ink of different colors can be suppressed from mixing together.

A main body portion of the air storage body 70 is constituted by a hollow container portion 71 open in one direction (FIG. 8). The container portion 71 is molded from a synthetic resin such as polypropylene, for example. In the second exemplary configuration, the container portion 71 is open in the −Y axis direction. The internal space of the container portion 71 is divided into a plurality of recessed portions 73 arranged in parallel in the X axis direction, by a partition wall 72 provided across the Z axis direction partitioning the internal space in the X axis direction. Each recessed portion 73 is open in the opening direction of the container portion 71. Each recessed portion 73 constitutes an air storage chamber 60. In the second exemplary configuration, one partition wall 72 and two recessed portions 73 are provided within the container portion 71. A plurality of partition walls 72 may be provided in the container portion 71 according to the quantity of air storage chambers 60 to be formed.

The container portion 71 has an approximately rectangular parallelepiped shape. The container portion 71 has five outer wall portions 701, 702, 704, 705, and 706 constituting outer wall faces of the air storage body 70. The first outer wall portion 701 has a first outer wall face facing in the −X axis direction (FIG. 8). The second outer wall portion 702 has a second outer wall face facing in the +X axis direction and is in a position facing the first outer wall portion 701 in the X axis direction (FIG. 7). In the second exemplary configuration, the first outer wall portion 701, the second outer wall portion 702, and the partition wall 72 described above are provided so as to be generally parallel to each other (FIG. 8).

The fourth outer wall portion 704 is at a position facing the opening of the container portion 71 in the Y axis direction, faces in the +Y axis direction, and has an outer wall face facing the liquid storage chamber 50 (FIG. 8). The fourth outer wall portion 704 intersects the first outer wall portion 701 and the second outer wall portion 702. The fifth outer wall portion 705 has an outer wall face that constitutes a top face facing in the +Z axis direction (FIGS. 7 and 8). The fifth outer wall portion 705 intersects the first outer wall portion 701, the second outer wall portion 702, and the fourth outer wall portion 704. The sixth outer wall portion 706 has an outer wall face that constitutes a bottom face facing in the −Z direction (FIGS. 7 and 8). The sixth outer wall portion 706 faces the fifth outer wall portion 705 in the Z axis direction and intersects the first outer wall portion 701, the second outer wall portion 702 and the fourth outer wall portion 704.

The air storage body 70 is further provided with a recessed portion sealing member 74 (FIG. 8). The recessed portion sealing member 74 is configured using a sheet-like or film-like member. The recessed portion sealing member 74 is joined to an opening circumferential portion of the container portion 71 by welding or the like to seal the opening of each recessed portion 73. The opening circumferential portion of the container portion 71 is constituted by end faces on the side in the −Y axis direction of the first outer wall portion 701, the second outer wall portion 702, the fifth outer wall portion 705, the sixth outer wall portion 706 and the partition wall 72. The recessed portion sealing member 74 constitutes a third outer wall portion 703 of the air storage body 70. The third outer wall portion 703 is at a position facing the fourth outer wall portion 704 in the Y axis direction, and intersects the first outer wall portion 701, the second outer wall portion 702, the fifth outer wall portion 705, and the sixth outer wall portion 706.

The air storage body 70 has a plurality of each of four types of opening members 62, 64, 65, and 66 respectively, similar to those described in the first embodiment, corresponding to the quantity of air storage chambers 60 (FIGS. 7 and 8). In the second exemplary configuration, two each of the four types of opening members 62, 64, 65, and 66 respectively are provided for each single air storage body 70.

The first opening members 62 and the second opening members 64 are provided for each air storage chamber 60 at a position corresponding to the position described in the first embodiment. The first opening members 62 are disposed above each air storage chamber 60 on the outer wall face of the fifth outer wall portion 705 (FIGS. 7 and 8). The atmosphere opening port 621 opens at the upper end of each air storage chamber 60 and is in communication with the inside of each air storage chamber 60 (FIG. 8). The atmosphere opening port 621 is open at the end in the −X axis direction on the upper inner wall face of each air storage chamber 60 and at the corner in the −Y axis direction. By providing the atmosphere opening port 621 at the upper end of the air storage chamber 60, liquid that has flowed from the liquid storage chamber 50 into the air storage chamber 60 can be suppressed from leaking outside of the air storage chamber 60 through the atmosphere opening port 621.

The second opening members 64 are provided on the outer wall face of the fourth outer wall portion 704 facing the liquid storage chamber 50 (FIG. 7). The second opening members 64 are provided at a position facing the first opening members 54 in communication with the liquid storage chamber 50 configured to be connected. The second opening members 64 are provided at a position lined up in a straight line in the Y axis direction with the first opening members 54 to be connected. The first liquid chamber side opening 641 opens at the end on the side in the −X axis direction at the upper end of the air storage chamber 60, and is in communication with the air storage chamber 60 (FIG. 8). In the air storage body 70 of the second exemplary configuration as well, because the second opening members 64 face the first opening members 54, the connection of the second opening members 64 to the first opening members 54 through the first hose (FIG. 3) is facilitated.

The third opening members 65 are provided at the lower end on the outer wall face of the fourth outer wall portion 704 facing the liquid storage chamber 50. The third opening members 65 are disposed in close proximity to each other in the corner on the lower side near the end in the +X axis direction. In the second exemplary configuration, the third opening members 65 are provided lined up parallel to the Z axis direction. One of the two third opening members 65 is provided at a position facing the second opening member 55 of the liquid storage chamber 50, and is lined up in a straight line in the Y axis direction with the second opening member 55. The other third opening member 65 is configured to be connected to the corresponding second opening member 55 by routing the second hose 96 (FIG. 3) in the X axis direction. Because at least one of the plurality of third opening members 65 in the air storage body 70 is facing the second opening member 55 of the liquid storage chamber 50, connection to the second opening member 55 through the second hose 96 (FIG. 3) is facilitated.

The fourth opening members 66 are provided so as to protrude in the −Y axis direction at the upper end of the third outer wall portion 703 constituted by the recessed portion sealing member 74 (FIGS. 7 and 8). The fourth opening members 66 protrude from the end face on the side in the −Y axis direction of the second outer wall portion 702 (FIG. 8). The fourth opening members 66 are provided at positions in close proximity to each other in the corner on the upper side near the end in the +X axis direction. The fourth opening members 66 are provided parallel to each other so as to be lined up in the Z axis direction. Because the plurality of fourth opening members 66 are grouped together in a local area, connection to the recording head 14 through the flow pipe 99 (FIG. 2) is facilitated.

In the air storage body 70, a plurality of liquid supply flow paths 67 in communication with each liquid storage chamber 50 are provided in the second outer wall portion 702, which is the outer wall of the air storage body 70 (FIG. 7). An outer wall provided with the plurality of liquid supply flow paths 67, such as the second outer wall portion 702, is also referred to as a "common outer wall". Each liquid supply flow path 67, in the outer wall face of the second outer wall portion 702, is formed by a groove 670 recessed inside of the air storage chamber 60 and a groove sealing member 75 that seals the groove 670. The groove sealing member 75 is a film-like member and is joined to the outer wall face of the second outer wall portion 702 by welding. In FIG. 7, a region where the groove sealing member 75 is to be disposed in the second outer wall portion 702 is indicated by a single-dotted chained line. In the second exemplary configuration, the plurality of grooves 670 constituting the liquid supply flow paths 67 are blocked by the common groove sealing member 75. Therefore, production of the liquid supply flow paths 67 is simplified, and the manufacturing cost of the air storage body 70 is reduced.

Each liquid supply flow path 67 is provided so as to extend in parallel without intersecting each other in the second outer wall portion 702. Each liquid supply flow path 67 is formed in an approximately L-shape. The liquid supply flow paths 67 extend in the Y axis direction from positions adjacent in the −Y axis direction with respect to the third opening members 65, and bend upward at positions nearer to the third outer wall portion 703 than the fourth outer wall portion 704, and then extend in the +Z axis direction up to the height position of the fourth opening member 66 to be connected.

Buffer chambers 671 and 672 are respectively provided at both ends of each liquid supply flow path 67. The first buffer chambers 671 are provided at the end adjacent to the third opening members 65. The second buffer chambers 672 are provided at the end adjacent to the fourth opening members 66. The first and second buffer chambers 671 and 672 are places where the opening area is larger than in other places in the groove 670, such that the flow path resistance is locally reduced. The liquid introduction ports 651, which are openings at one end of the third opening members 65, are open in the first buffer chambers 671. The liquid outlet ports 661, which are openings at one end of the fourth opening members 66, are open in the second buffer chambers 672. One or both of the first and second buffer chambers 671 and 672 may be omitted.

Grooves constituting each liquid supply flow path 67 of the second exemplary configuration are provided outside of protruding portions 76 where the inner wall face of the second outer wall portion 702 protrudes into the air storage chamber 60 on the side of the second outer wall portion 702. That is, each liquid supply flow path 67 of the second exemplary configuration protrudes into the air storage chamber 60 on the side of the second outer wall portion 702. As a result, in places other than where the liquid supply flow paths 67 are formed, the thickness of the second outer wall portion 702 is suppressed from becoming unnecessarily large, so the air storage body 70 can be reduced in size and lightened.

As described above, according to the liquid supply device 20*b* of the second exemplary configuration, a plurality of liquid supply flow paths 67 to be connected to a plurality of liquid storage chambers 50 are provided in the air storage body 70, and the liquid supply device 20*b* can be reduced in size. Also, because a single air storage body 70 is configured to be connected in common to the plurality of liquid storage chambers 50, the connection between the liquid storage chamber 50 and the air storage chamber 60 is simplified. Also, it is possible to install the plurality of liquid storage chambers 50 and the air storage body 70 together in a small space, and possible to simplify the configuration of the liquid supply device 20*b*. In addition, according to the second exemplary configuration of the liquid supply device 20*b*, in addition to the various operational effects described in the second exemplary configuration, the various operational effects described in the first exemplary configuration and the first embodiment can be exhibited.

A-4-3. Third Exemplary Configuration

Figure 9:
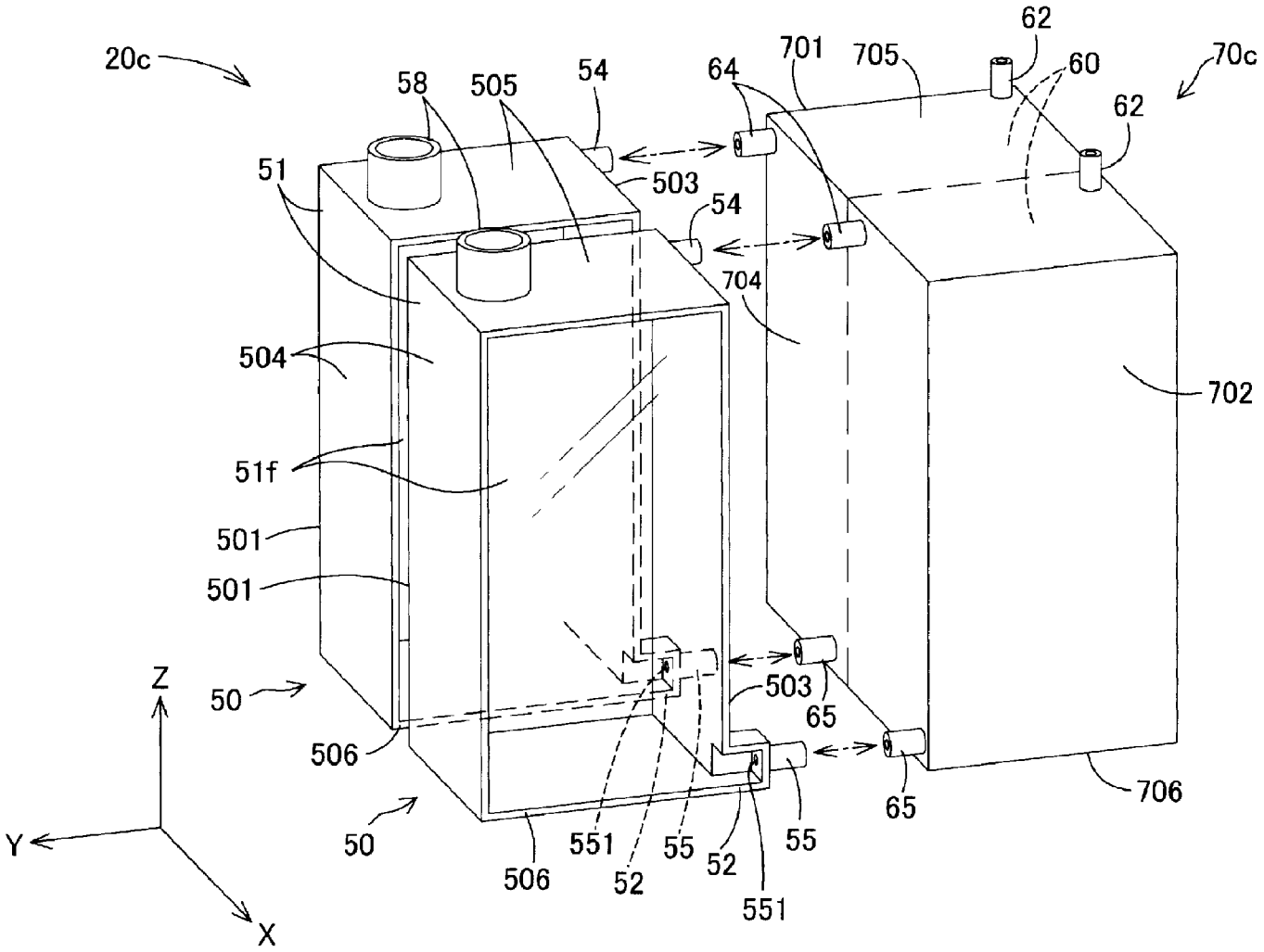
FIG. 9 is a first schematic perspective view showing a liquid supply device of a third exemplary configuration.
Figure 10:
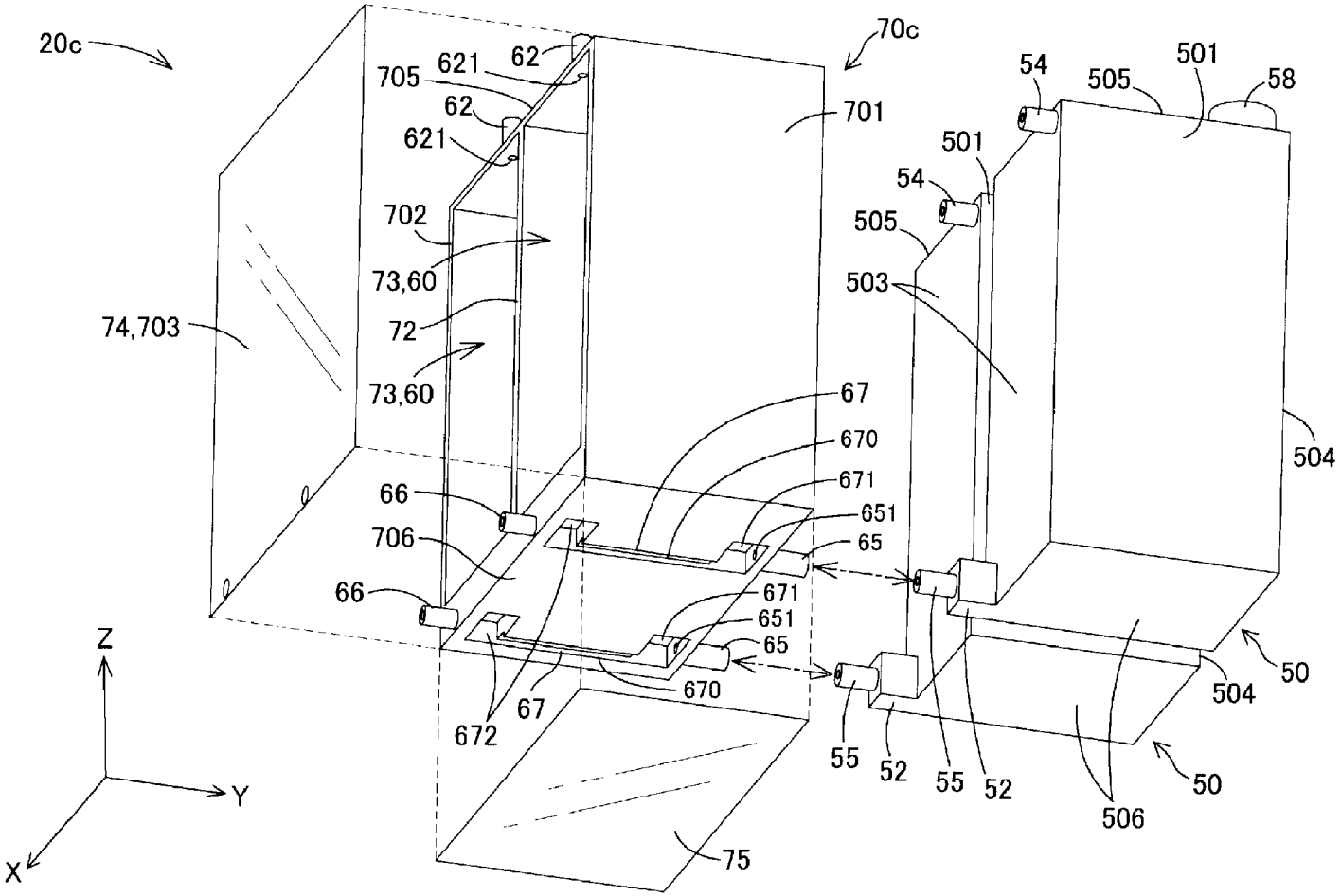
FIG. 10 is a second schematic perspective view showing a liquid supply device of a third exemplary configuration.

A liquid supply device 20*c* of a third exemplary configuration that is one variation of the liquid supply device 20 of the first embodiment will now be described with reference to FIGS. 9 and 10. FIG. 9 is a schematic perspective view showing the liquid supply device 20*c* of the third exemplary configuration, viewed from the +Y axis direction side and the +Z axis direction side. FIG. 10 is a schematic perspective view showing the liquid supply device 20*c* of the third exemplary configuration, viewed from the −Y axis direction side and the −Z axis direction side. The liquid supply device 20*c* of the third exemplary configuration differs from the liquid supply device 20*b* of the second exemplary configuration in that the liquid supply device 20*c* is provided with an air storage body 70*c* having a different configuration than the air storage body 70 of the second exemplary configuration, and otherwise has approximately the same configuration as the liquid supply device 20*b* of the second exemplary configuration.

The air storage body 70*c* of the third exemplary configuration has approximately the same configuration as the air storage body 70 of the second exemplary configuration, except as described below. In the air storage body 70*c* of the third exemplary configuration, the third opening members 65 are provided at a position facing in the Y axis direction and facing the second opening members 55 of the liquid storage chamber 50 to be connected, similar to the configuration described in the first embodiment (FIG. 9). Therefore, connection of the third opening members 65 to the second opening members 55 through the second hose 96 (FIG. 3) is facilitated.

In the air storage body 70*c* of the third exemplary configuration, the fourth opening members 66 are provided at the lower end on the side of the third outer wall portion 703 (FIG. 10). The fourth opening members 66 each protrude in the −Y axis direction from the end face on the side in the −Y axis direction of the sixth outer wall portion 706. The fourth opening members 66 are each provided at a position lined up in a straight line in the Y axis direction with the corresponding third opening member 65.

In the air storage body 70*c* of the third exemplary configuration, a plurality of liquid supply flow paths 67 connecting the third opening members 65 and the fourth opening members 66 are embedded in the sixth outer wall portion 706, which is a common outer wall (FIG. 10). Each liquid supply flow path 67 is provided below the air storage chamber 60 corresponding to the liquid storage chamber 50 to be connected. Each liquid supply flow path 67 is formed with a groove 670 recessed in the side of the above air storage chamber 60, and a groove sealing member 75 configured to be joined to the outer wall face of the sixth outer wall portion 706 so as to seal the groove 670. Each liquid supply flow path 67 extends in a straight line in the Y axis direction, and first and second buffer chambers 671 and 672 are provided at both ends of each liquid supply flow path 67.

According to the air storage body 70*c* of the third exemplary configuration, the configuration of the liquid supply flow paths 67 is simplified. According to the liquid supply device 20*c* of the third exemplary configuration, in addition to the various operational effects described in the third exemplary configuration, various operational effects described in the first exemplary configuration, the second exemplary configuration, and the first embodiment can be exhibited.

B. Second Embodiment

In the second embodiment, a liquid supply device that supplies ink to a printer serving as an liquid ejection device, and a liquid storage unit and an air storage chamber that constitute the liquid supply device, will be described using the principles of a Mariotte bottle. Below, only the portions having a different configuration and operation than the first embodiment will be described. Note that in the drawings, similar configurations and operations as those of the first embodiment are denoted by similar reference signs as previously described in the first embodiment, and a detailed description thereof will be omitted here. In other words, configurations and operations not described below are the same as in the first embodiment described above.

B-1. Configuration of Liquid Ejection System

Figure 11:
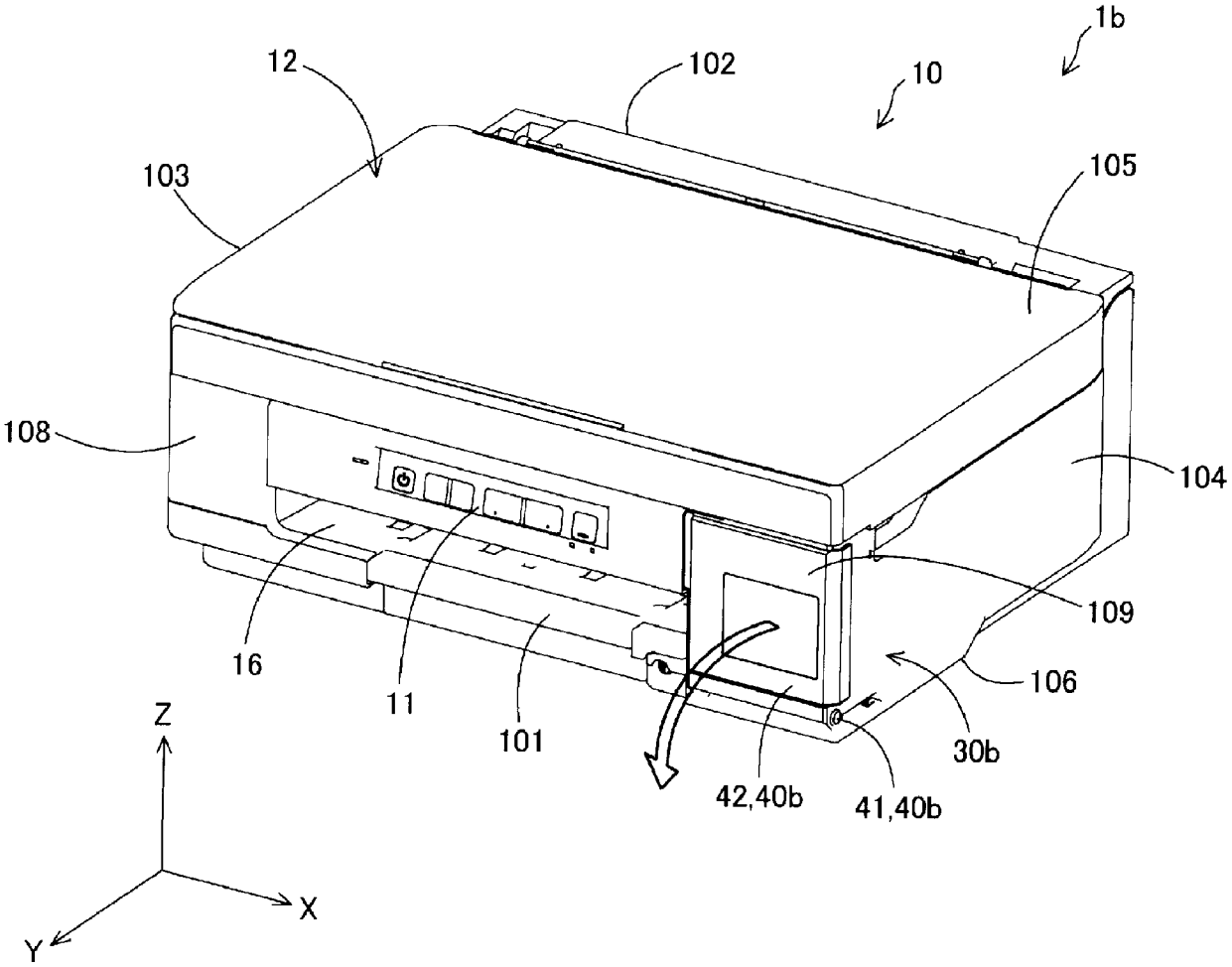
FIG. 11 is a schematic view of a liquid ejection system of a second embodiment.
Figure 12:
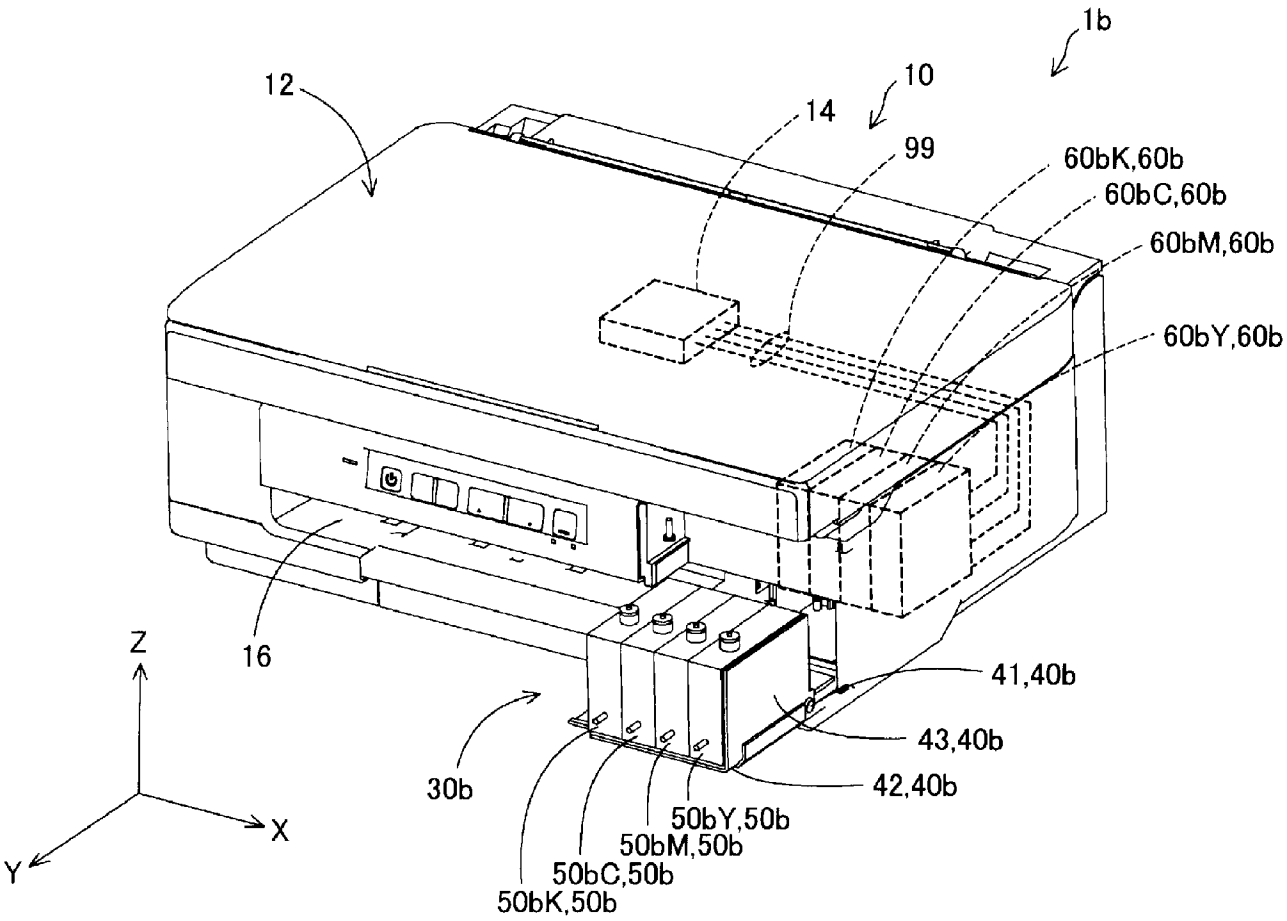
FIG. 12 is a schematic view of a liquid ejection system of a second embodiment.

FIGS. 11 and 12 are schematic views of a liquid ejection system 1*b* of the second embodiment. FIG. 11 shows an external view of the liquid ejection system 1*b*, and FIG. 12 shows an external view and part of an internal structure of the liquid ejection system 1*b*. The internal structure in FIG. 12 is indicated by broken lines. Differences from the first embodiment shown in FIGS. 1 and 2 are that a liquid storage unit 30*b* including a liquid storage chamber 50*b* is provided instead of the liquid storage unit 30, and an air storage chamber 60*b* is provided instead of the air storage chamber 60.

The liquid storage unit 30*b* is attached to a right side portion of a front face 101 of a housing 12. The liquid storage unit 30*b* includes a case 40*b* and a plurality of liquid storage chambers 50*b*K to 50*b*Y disposed within the case 40*b*. The case 40*b* is configured from three members (a hinge 41, an outside case 42, and an inside case 43) as shown in FIG. 12. The configuration of the outside case 42 and inside case 43 is similar to the first embodiment. The hinge 41 is attached at the border between the housing 12 and the inside case 43. In the usage state shown in FIG. 11, force in the Y axis direction is applied to the outside case 42, whereby the case 40*b* rotates around the hinge 41 in the direction of the arrow (FIG. 11). As a result, the liquid storage unit 30*b* is set to the liquid replenishment state shown in FIG. 12.

B-2. Configuration of Liquid Supply Device

Figure 13:
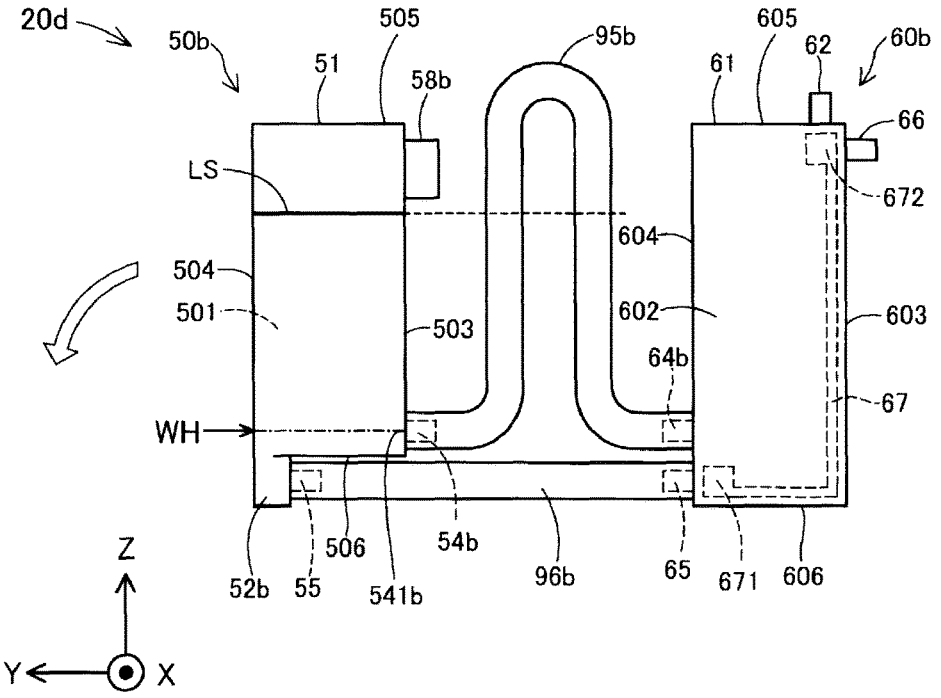
FIG. 13 shows a schematic configuration of a liquid supply device in a usage state.
Figure 14:
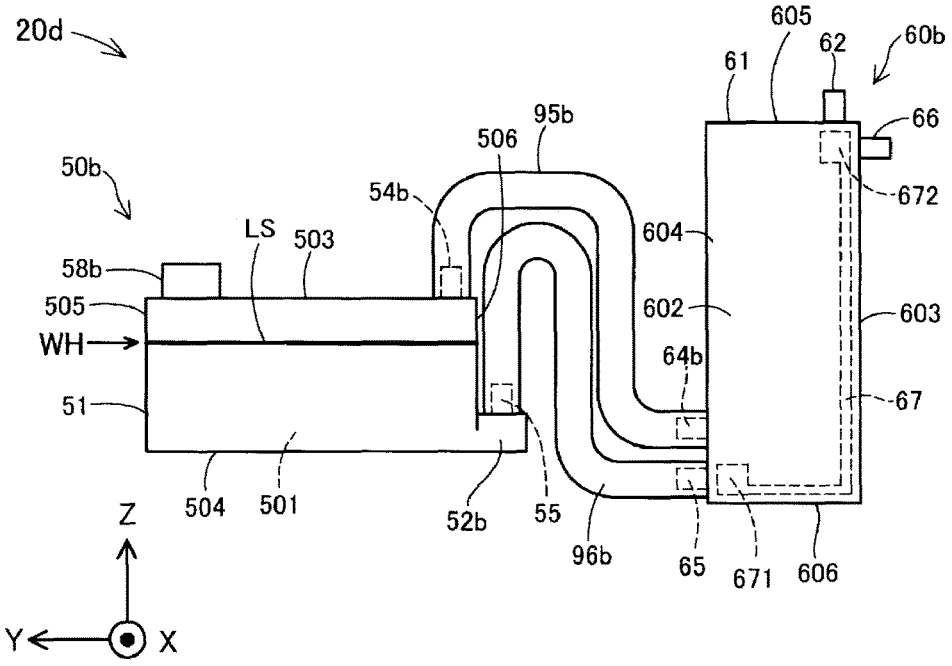
FIG. 14 shows a schematic configuration of a liquid supply device in a liquid replenishment state.

FIG. 13 shows the schematic configuration of the liquid supply device 20*d* of the second embodiment in the usage state. FIG. 14 shows the schematic configuration of the liquid supply device 20*d* in the liquid replenishment state. In FIGS. 13 and 14, the liquid supply device is schematically shown viewed from the side of the +X axis direction.

The differences from the first embodiment shown in FIGS. 3 and 4 are that the liquid storage chamber 50*b* is provided instead of the liquid storage chamber 50, the air storage chamber 60*b* is provided instead of the air storage chamber 60, a first hose 95*b* and a second hose 96*b* are provided instead of the first hose 95 and the second hose 96, and the attitude of the air storage chamber 60*b* changes between the usage state and the liquid replenishment state.

The differences between the liquid storage chamber 50*b* and the liquid storage chamber 50 (FIG. 3) are that a protruding portion 52*b* is provided instead of the protruding portion 52, a first opening member 54*b* is provided instead of the first opening member 54, and a liquid injection portion 58*b* is provided instead of the liquid injection portion 58. The protruding portion 52*b* is connected to one end of the fourth wall 506 of the main body 51. Other parts of the configuration of the protruding portion 52*b* are the same as the protruding portion 52.

The first opening member 54*b* is disposed to the outside of the main body 51 at one end on the lower side in the vertical direction of the first side wall 503 of the main body 51. Also, an air introduction port 541*b* (FIG. 13), which is an opening at one end of the first opening member 54*b*, is in communication with the inside of the liquid storage chamber 50*b* through the opening of the main body 51. In the present embodiment, in the usage state shown in FIG. 13, a fluid level LS of ink is positioned above the air introduction port 541 *b* in the vertical direction. Therefore, in the usage state shown in FIG. 13, a fluid level (meniscus) directly communicating with the atmosphere is formed near the air introduction port 541*b* of the liquid storage chamber 50*b*, and air is introduced into the liquid storage chamber 50*b* in the form of bubbles introduced from the air introduction port 541*b*. The opening at the other end of the first opening member 54*b* is in communication with the inside of the air storage chamber 60*b* through the first hose 95*b*. Other parts of the configuration of the first opening member 54*b* are the same as the first opening member 54.

The liquid injection portion 58*b* is disposed to the outside of the main body 51 at a predetermined position on the upper side in the vertical direction of the first side wall 503 of the main body 51. Other parts of the configuration of the liquid injection portion 58*b* are the same as the liquid injection portion 58.

The only difference between the air storage chamber 60*b* and the air storage chamber 60 (FIG. 3) is that a second opening member 64*b* is provided instead of the second opening member 64. The second opening member 64*b* is disposed to the outside of the main body 61 at a position on the lower side in the vertical direction of the second side wall 604 of the main body 61 and facing the first opening member 54*b* of the liquid storage chamber 50*b*. Other parts of the configuration of the second opening member 64*b* are the same as the second opening member 64.

Similar to the first embodiment, the first hose 95*b* is configured to connect the first opening member 54*b* of the liquid storage chamber 50*b* to the second opening member 64*b* of the air storage chamber 60*b*. The flow path cross-sectional area of the first hose 95*b* of the present embodiment, or the inner diameter of the first hose 95*b*, is preferably small enough that it is possible to form a meniscus (a fluid level bridge) in the vicinity of the air introduction port 541*b* of the liquid storage chamber 50*b*. Also, the first hose 95*b* of the present embodiment is longer than a length obtained by summing the height (length in the Z axis direction) of the liquid storage chamber 50*b*, the height (length in the Z axis direction) of the air storage chamber 60*b*, and the distance between the liquid storage chamber 50*b* and the air storage chamber 60*b* (the shortest length between the positions where the liquid storage chamber 50*b* and the air storage chamber 60*b* are disposed). Therefore, in the usage state shown in FIG. 13, the first hose 95*b* is curved in the vertical direction (the Z axis direction) between the liquid storage chamber 50*b* and the air storage chamber 60*b*, and a part of the first hose 95*b* is positioned above the position of a full ink level in the vertical direction.

Similar to the first embodiment, the second hose 96*b* is configured to connect the second opening member 55 of the liquid storage chamber 50*b* to the third opening member 65 of the air storage chamber 60*b*. The second hose 96*b* of the present embodiment is longer than a length obtained by summing the depth (length in the Y axis direction) of the liquid storage chamber 50*b*, the depth (length in the Y axis direction) of the air storage chamber 60*b*, and the distance between the liquid storage chamber 50*b* and the air storage chamber 60*b* (the shortest length between the positions where the liquid storage chamber 50*b* and the air storage chamber 60*b* are disposed). Therefore, in the usage state shown in FIG. 13, the second hose 96*b* is curved in the width direction (the X axis direction) between the liquid storage chamber 50*b* and the air storage chamber 60*b*.

B-3. Atmospheric Release Flow Path and Liquid Supply Flow Path

The atmospheric flow using the atmospheric release flow path in the above-described liquid supply device (the liquid storage unit 30*b*, and the air storage chamber 60*b*) is the same as the first embodiment. However, as described above, air supplied from the atmospheric release flow path to the liquid storage chamber 50*b* takes the form of bubbles from the air introduction port 541*b* of the liquid storage chamber 50*b*.

The flow of ink using the liquid supply flow path in the above-described liquid supply device 20*d*, and the liquid storage unit 30*b* and the air storage chamber 60*b* constituting the liquid supply device 20*d*, is the same as the first embodiment. In the liquid supply device 20*d* of the present embodiment, when the amount of ink remaining in the liquid storage chamber 50*b* has decreased, the user opens the case 40*b* (FIG. 13), and sets the liquid storage unit 30*b* to a state in which the liquid storage unit 30*b* can be seen from the outside. The attitude of the liquid supply device 20*d* at this time is the state shown in FIG. 14. The user removes an unshown plug member from the liquid injection portion 58*b* and replenishes ink into the liquid storage chamber 50*b* from the opening of the liquid injection portion 58*b*. Afterward, the user hermetically closes the liquid injection portion 58*b* with the plug member, closes the case 40*b* (FIG. 12), and sets the attitude of the liquid storage unit 30*b* to the state shown in FIG. 13. With this change in attitude, air within the liquid storage chamber 50*b* expands, and there is negative pressure inside of the liquid storage chamber 50*b*. Also, by ink in the liquid storage chamber 50*b* being sucked from the recording head 14, the inside of the liquid storage chamber 50*b* is kept at a negative pressure. In this way, the liquid supply device of the present embodiment uses the principles of a Mariotte bottle to supply ink to the recording head 14.

According to also the liquid supply device 20*d* of the second embodiment, and the liquid storage unit 30*b* and the air storage chamber 60*b* constituting this liquid supply device 20*d*, the same effects as in the first embodiment can be exhibited.

B-4. Other Exemplary Configurations of Liquid Supply Device

The configurations of the liquid supply device 20*d* of the second embodiment described above and the liquid storage unit 30*b* and the air storage chamber 60*b* constituting this liquid supply device 20*d* are merely examples, and various modifications are possible. Below, a liquid supply device 20*e* will be described as another exemplary configuration of the liquid supply device 20*d* of the second embodiment. Note that in the drawings, similar configurations and operations as those of the second embodiment are denoted by similar reference signs as previously described in the second embodiment, and a detailed description thereof will be omitted here.

Figure 15:
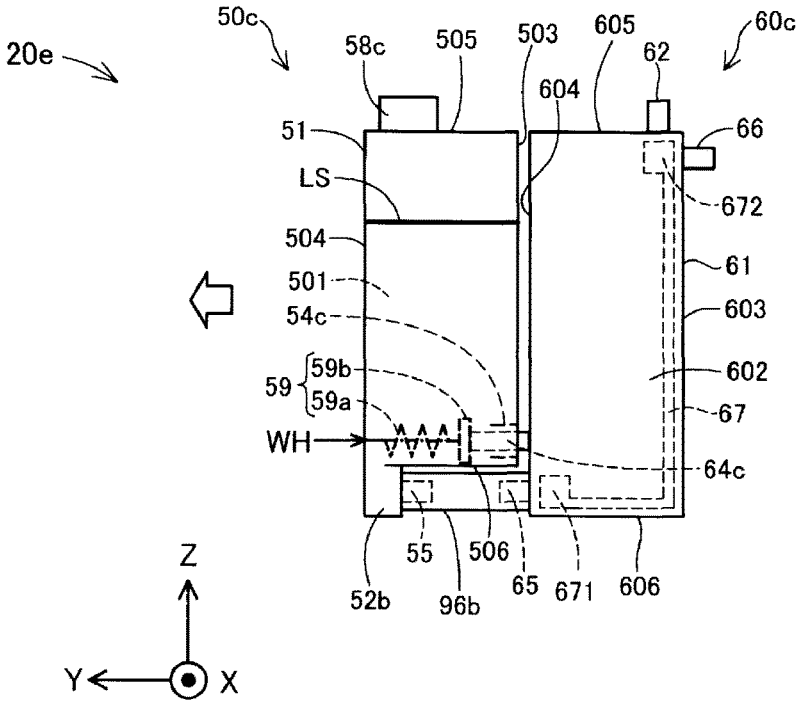
FIG. 15 shows a schematic configuration of another liquid supply device in a usage state.
Figure 16:
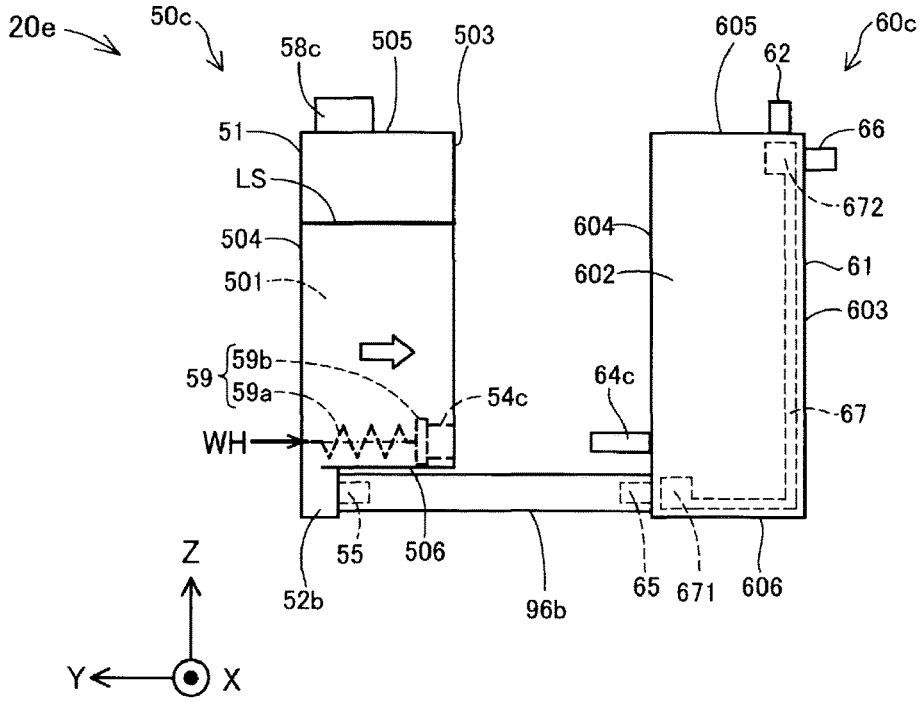
FIG. 16 shows a schematic configuration of another liquid supply device in a liquid replenishment state.

FIG. 15 shows the schematic configuration of the liquid supply device 20*e* in the usage state. FIG. 16 shows the schematic configuration of the liquid supply device 20*e* in the liquid replenishment state. In FIGS. 15 and 16, the liquid supply device 20*e* is schematically shown viewed from the side of the +X axis direction. The differences from the liquid supply device 20*d* shown in FIGS. 13 and 14 are that a liquid storage chamber 50*c* is provided instead of the liquid storage chamber 50*b*, an air storage chamber 60*c* is provided instead of the air storage chamber 60*b*, and the first hose 95*b* is not provided.

The differences between the liquid storage chamber 50*c* and the liquid storage chamber 50*b* (FIG. 13) are that a first opening member 54*c* is provided instead of the first opening member 54*b*, a liquid injection portion 58*c* is provided instead of the liquid injection portion 58*b*, and a valve mechanism 59 is further provided. The first opening member 54*c* is disposed inside of the main body 51 at one end on the lower side in the vertical direction of the first side wall 503 of the main body 51 (FIG. 15). The liquid injection portion 58*c* is disposed outside of the main body 51 at a predetermined position of the third wall 505 of the main body 51. Other parts of the configuration of the liquid injection portion 58*c* are the same as the liquid injection portion 58*b*.

The valve mechanism 59 is provided with, for example, an elastic body 59*a* such as a spring and a hermetic closing member 59*b*. The hermetic closing member 59*b* is formed in a size that covers the opening of the first opening member 54*c* with an elastic material. The hermetic closing member 59*b* is biased in the direction from the second side wall 504 toward the first side wall 503 (that is, the direction blocking the first opening member 54*c*) by the elastic body 59*a*. Therefore, in a state in which no force is applied from outside, the valve mechanism 59 closes the opening of the first opening member 54*c*.

The only difference between the air storage chamber 60*c* and the air storage chamber 60*b* (FIG. 13) is that a second opening member 64*c* is provided instead of the second opening member 64*b*. The second opening member 64*c* is a cylindrically shaped member open at one end. A cutout is provided in the cylinder portion at the other end (the end on the side not open) of the second opening member 64*c*. In the present embodiment, this cutout functions as an "air introduction port". The second opening member 64*c* is disposed outside of the main body 61 at a position on the lower side in the vertical direction of the second side wall 604 of the main body 61 and facing the first opening member 54*c* of the liquid storage chamber 50*c*. The opening at one end of the second opening member 64*c* is in communication with the opening of the main body 61, and the other end (the end on the side not open) of the second opening member 64*c*, in the usage state shown in FIG. 15, enters into the liquid storage chamber 50*c* from the opening of the first opening member 54*c* and pushes the hermetic closing member 59*b* of the valve mechanism 59.

The atmospheric flow using the atmospheric release flow path in the liquid storage unit 30*c* and the air storage chamber 60*c* of the other liquid supply device 20*e* described above is the same as the second embodiment. That is, air supplied from the atmospheric release flow path to the liquid storage chamber 50*c* takes the form of air bubbles from the cutout (the air introduction port) of the second opening member 64*c*.

The flow of ink using the liquid supply flow path in the liquid storage unit 30*c* and the air storage chamber 60*c* of the liquid supply device 20*e* described above also is the same as the second embodiment. In this liquid supply device 20*e*, when the amount of ink remaining in the liquid storage chamber 50*c* has decreased, the user pulls out the case 40 in the Y axis direction as shown by an outlined arrow in FIG. 1. Then, as the second opening member 64*c* that had entered into the liquid storage chamber 50*c* is removed, the pushing on the valve mechanism 59 is released and the valve mechanism 59 is closed. Specifically, as shown by the outlined arrow in FIG. 16, the hermetic closing member 59*b* of the valve mechanism 59 closes the first opening member 54*c* by the biasing of the elastic body 59*a*. In the liquid storage unit 30*c* in the liquid replenishment state shown in FIG. 16, in which the liquid storage unit 30*c* has been pulled out, each liquid storage chamber 50*c* has the attitude shown in FIG. 16. In this way, with the change from the attitude of the usage state (FIG. 15) to the attitude of the liquid replenishment state (FIG. 16), and the change from the attitude of the liquid replenishment state to the attitude of the usage state, an actual change in attitude occurs only in the liquid storage chamber 50*c*, and a change in attitude does not occur in the air storage chamber 60*c*.

Also in the liquid supply device 20*e* serving as another exemplary configuration of the second embodiment, and the liquid storage unit 30*c* and the air storage chamber 60*c* constituting this liquid supply device 20*e*, the same effects as in the second embodiment can be exhibited.

C. Variations

Note that the present invention is not limited to the embodiments and exemplary configurations described above, and can be implemented in various modes without departing from the gist of the invention, and for example, the following sorts of modifications are also possible.

Variation 1

In the above embodiments and exemplary configurations, configurations of a liquid supply device are disclosed as examples. However, the configuration of the liquid supply device can be arbitrarily determined without departing from the gist of the present invention. For example, each constituent portion can be added, deleted, converted, or the like.

Disposal of each member (the protruding portion, the first opening member, the second opening member, the liquid injection portion, the liquid supply flow path, or the valve member) presumed to be formed in the liquid storage chamber, and each member (the first to fourth opening members, or the liquid supply flow path) presumed to be formed in the air storage chamber, can be arbitrarily changed.

The liquid supply flow path formed in the liquid storage chamber and the air storage chamber may be formed, in the wall of the liquid storage chamber or air storage chamber, so as to protrude to the opposite side as the inside of the chamber configured to store liquid (or air). In this case, the liquid supply flow path may be formed in any wall among the top face, the bottom face, the right side face, the left side face, the front face, and the back face. By adopting such a configuration, the liquid supply flow path does not protrude inside of the liquid storage chamber or the air storage chamber. Therefore, it is possible to suppress a decrease in the volume of the liquid storage chamber or the air storage chamber due to providing the liquid supply flow path.

The first hose and the second hose do not have to be formed by a flexible member. For example, at least one of these hoses may be constituted from an elastic member, or may be formed from a similar synthetic resin as the main body.

A moisture-permeable waterproof member (for example, a gas-liquid separation film) may further be disposed within the air storage chamber, between the fourth opening member of the air storage chamber and the flow pipe, or the like.

The configuration (the blocking member and the elastic body) of the above-described valve mechanism is merely an example, and other configurations may also be adopted. Specifically, the blocking member may be biased using a solenoid or hydraulic pressure instead of an elastic body. The material and shape of the blocking member can also be arbitrarily changed.

In the above embodiments and exemplary configurations, one air storage chamber is connected to one liquid storage chamber. On the other hand, one air storage chamber may be connected in common to a plurality of liquid storage chambers.

In the above embodiments and exemplary configurations, the liquid supply flow path is formed by sealing the groove provided in the wall with a film-like member. On the other hand, the liquid supply flow path may be formed by another method. For example, the liquid supply flow path may be formed on a wall of the air storage chamber by disposing a member that constitutes the liquid supply flow path. The liquid supply flow path may be formed by joining a plate-like member having a groove formed on one face to a wall of the air storage chamber such that the groove is sealed. In the liquid supply flow path, a tubular member such as a tube constituting the liquid supply flow path may be disposed in a wall of the air storage chamber. The tubular member may be held by a holding portion provided in the wall of the air storage chamber. The holding portion may be configured, for example, with an arc-like claw portion disposed along an outer circumference of the tubular member, or may be provided as a recessed portion of a wall of the air storage chamber.

In the above second exemplary configuration, the plurality of liquid supply flow paths 67 are provided in the second outer wall portion 702 that is a common outer wall, and in the above third exemplary configuration, the plurality of liquid supply flow paths 67 are provided in the sixth outer wall portion 706 that is a common outer wall. The plurality of liquid supply flow paths 67 may also be provided in an outer wall portion other than the second outer wall portion 702 and the sixth outer wall portion 706. For example, the plurality of liquid supply flow paths 67 may be provided in the first outer wall portion 701.

In the above second exemplary configuration, and third exemplary configuration, each of the plurality of liquid supply flow paths 67 may be provided in a separate outer wall portion. For example, a configuration may be adopted in which a first liquid supply flow path 67 is provided in the first outer wall portion 701, and a second liquid supply flow path 67 is provided in the second outer wall portion 702.

Variation 2

In the above embodiments and exemplary configurations, configurations of a liquid ejection system are disclosed as examples. However, the configuration of the liquid ejection system can be arbitrarily determined without departing from the gist of the present invention. For example, each constituent portion can be added, deleted, converted, or the like.

In the configuration of the second embodiment, a different attitude than the attitude when replenishing liquid described in the above embodiments may be adopted. For example, a configuration may be adopted in which an unshown rail is built in, and liquid is replenished by shifting the liquid storage chambers of the liquid storage unit with the case in the X axis direction to expose each liquid storage chamber to the outside of the printer housing. In this case, it is preferable that a liquid injection portion is provided at the top face of the liquid storage chamber.

In the liquid ejection system, the liquid storage unit may store a liquid (for example, a resin liquid, or the like) other than ink. Each of the devices listed below can be adopted as a liquid ejection device employing a liquid ejection system that stores another liquid.

1. Image recording devices such as facsimile devices

2. Color material ejection recording devices used in manufacturing color filters for image display devices such as liquid crystal displays 3. Electrode material ejection devices used in electrode formation such as an organic EL (ElectroLuminescence) display or a surface emission display (Field Emission Display, FED)

4. Liquid ejection devices that eject a liquid containing bioorganic matter used in biochip manufacturing 5. Sample ejection devices used as precision pipettes 6. Lubricating oil ejection devices 7. Resin liquid ejection devices 8. Liquid ejection devices that consume lubricating oil at a pinpoint in precision machines such as watches and cameras 9. Liquid ejection devices that eject a transparent resin liquid such as an ultraviolet-curable resin liquid or the like onto a substrate to form a micro-semispherical lens (optical lens) or the like used in an optical communication element or the like 10. Liquid ejection devices that eject an acidic or alkaline etching solution to etch a substrate or the like 11. Liquid ejection devices provided with a liquid ejecting head that ejects other arbitrary droplets in a minute amount Note that "droplet" refers to the state of liquid ejected from a liquid ejecting recording device or a liquid ejection device, including those having a granular shape, a tear-drop shape, and a shape having a thread-like trailing end. Also, the term "liquid" used here may be any material such that a liquid ejecting recording device or a liquid ejection device can eject the liquid. For example, a "liquid" may be any material in a state when the substance is in a liquid phase, and includes a liquid state material having a high or low viscosity state, and liquid state material such as a sol, gel water, other inorganic solvents, organic solvents, solutions, and liquid resin and liquid metal (metallic melt) are also encompassed by the term "liquid". Also, "liquid" includes not only liquid as one state of a substance but also particles obtained by dissolving, dispersing or mixing particles of a functional material of solid matter such as pigment and metallic particles in a solvent. Also, representative examples of liquid include ink as described in the above embodiments, liquid crystal, and the like. Here, "ink" is intended to encompass various liquid compositions such as ordinary water-based ink and oil-based ink, gel ink, hot melt ink, and the like. Also, when UV ink that can be cured by irradiating ultraviolet rays is stored in this liquid storage unit and connected to the printer, a liquid storage bag floats away from the installation surface, so there is a reduced possibility that heat from the installation surface will be transferred to the liquid storage unit and cure the ink.

The present invention is not limited to the embodiments, examples, and variations described above, and can be realized in various configurations within a range not departing from the gist of the invention. For example, the technical features in embodiments, examples, and variations corresponding to the technical features in each mode described in the summary of the invention, in order to solve some or all of the above-described problems, or alternatively, in order to achieve some or all of the above effects, can be substituted or combined as appropriate. Also, unless those technical features are described as essential in this specification, they can be deleted as appropriate.

What is claimed is:

1. A liquid supply device that supplies a liquid to a head that ejects the liquid to an object, the liquid supply device comprising:

a liquid storage chamber configured to store the liquid;

a liquid injection portion in communication with the liquid storage chamber, and configured to inject the liquid into the liquid storage chamber;

an air introduction port that is an opening provided in the liquid storage chamber to introduce air into the liquid storage chamber;

an atmospheric release flow path where one end is in communication with the air introduction port, and another end is open to the atmosphere; and an air storage chamber configured to store air, and provided in a portion of the atmospheric release flow path;

wherein a liquid supply flow path that supplies the liquid from the liquid storage chamber to the head is formed in a wall defining the air storage chamber, wherein the liquid supply flow path, in the wall of the air storage chamber, is formed protruding inside of the air storage chamber configured to store air, and does not protrude outside of the air storage chamber.

2. The liquid supply device according to claim 1, wherein the liquid storage chamber further includes, at a position facing an opening at one end of the liquid supply flow path, a liquid outlet portion that is an exit of the liquid from the liquid storage chamber.

3. The liquid supply device according to claim 1, wherein the air storage chamber further includes, at a position facing the air introduction port, an opening that functions as a portion of the atmospheric release flow path.

4. The liquid supply device according to claim 1, wherein an opening at one end of the liquid supply flow path is provided at an upper end in the vertical direction of the air storage chamber.

5. The liquid supply device according to claim 1, wherein the air storage chamber includes:

a housing that is hollow and opens in one direction, an internal space of the housing forming the inside of the air storage chamber, and a first sealing member that seals the opening of the housing, and the liquid supply flow path includes:

a groove that, in at least one wall of the housing, is formed so as to protrude toward the inside of the air storage chamber, and constitutes the liquid supply flow path, and a second sealing member that seals the groove.

6. A liquid supply device that supplies a liquid to a head that ejects the liquid to an object, the liquid supply device comprising:

a liquid storage chamber configured to store the liquid;

a liquid injection portion in communication with the liquid storage chamber, and configured to inject the liquid into the liquid storage chamber;

an air introduction port that is an opening provided in the liquid storage chamber to introduce air into the liquid storage chamber;

an atmospheric release flow path where one end is in communication with the air introduction port, and another end is open to the atmosphere;

an air storage chamber configured to store air, and provided in a portion of the atmospheric release flow path;

wherein a liquid supply flow path that supplies the liquid from the liquid storage chamber to the head is formed in a wall defining the air storage chamber;

a plurality of the liquid storage chambers; and a hollow air storage body, inside of which is configured the air storage chamber configured to be connected to each of the plurality of liquid storage chambers, the air storage body having an outer wall defining the air storage chamber;

wherein a plurality of the liquid supply flow paths in communication with the respective liquid storage chambers are formed in the outer wall.

7. The liquid supply device according to claim 6, wherein the air storage body includes:

a plurality of the outer walls intersecting each other, a plurality of grooves provided in a common outer wall that is one of the plurality of outer walls, the grooves constituting the plurality of liquid supply flow paths, and a groove sealing member joined to the common outer wall to seal the plurality of grooves.

8. The liquid supply device according to claim 6, wherein the air storage body internally has a plurality of the air storage chambers partitioned from each other, and each of the plurality of air storage chambers is connected to one corresponding liquid storage chamber among the plurality of liquid storage chambers.

9. The liquid supply device according to claim 8, wherein the air storage body includes:

a container portion that is hollow and opens in one direction, an internal space of the container portion being open in the one direction and partitioned by a plurality of recessed portions that constitute the plurality of air storage chambers, and a recessed portion sealing member that seals each of the recessed portions.

10. A liquid ejection system, comprising:

the liquid supply device according to claim 1;

a liquid ejection device having the head; and a flow pipe that connects the liquid supply device to the head, and allows the liquid within the liquid storage chamber to flow to the head.

11. A liquid ejection system, comprising:

the liquid supply device according to claim 2;

a liquid ejection device having the head; and a flow pipe that connects the liquid supply device to the head, and allows the liquid within the liquid storage chamber to flow to the head.

12. A liquid ejection system, comprising:

the liquid supply device according to claim 3;

a liquid ejection device having the head; and a flow pipe that connects the liquid supply device to the head, and allows the liquid within the liquid storage chamber to flow to the head.

13. A liquid ejection system, comprising:

the liquid supply device according to claim 4;

a liquid ejection device having the head; and a flow pipe that connects the liquid supply device to the head, and allows the liquid within the liquid storage chamber to flow to the head.

14. A liquid ejection system, comprising:

the liquid supply device according to claim 5;

a liquid ejection device having the head; and a flow pipe that connects the liquid supply device to the head, and allows the liquid within the liquid storage chamber to flow to the head.

15. A liquid ejection system, comprising:

the liquid supply device according to claim 6;

a liquid ejection device having the head; and a flow pipe that connects the liquid supply device to the head, and allows the liquid within the liquid storage chamber to flow to the head.

16. A liquid ejection system, comprising:

the liquid supply device according to claim 7;

a liquid ejection device having the head; and a flow pipe that connects the liquid supply device to the head, and allows the liquid within the liquid storage chamber to flow to the head.

* * * * *